US007761181B2

(12) United States Patent
Ullman et al.

(10) Patent No.: US 7,761,181 B2
(45) Date of Patent: Jul. 20, 2010

(54) LINE REPLACEABLE SYSTEMS AND METHODS

(75) Inventors: Alan Z. Ullman, Northridge, CA (US); Michael W. Traffenstedt, Moorpark, CA (US); Rose M. Ahart, Canoga Park, CA (US); Harry H. Wang, Newbury Park, CA (US)

(73) Assignee: The Boeing Company, Chicago, IL (US)

( * ) Notice: Subject to any disclaimer, the term of this patent is extended or adjusted under 35 U.S.C. 154(b) by 1268 days.

(21) Appl. No.: 11/289,021

(22) Filed: Nov. 29, 2005

(65) Prior Publication Data

US 2007/0121688 A1 May 31, 2007

(51) Int. Cl.
*G06F 19/00* (2006.01)
*G02B 7/02* (2006.01)
*G02B 6/36* (2006.01)

(52) U.S. Cl. ..... 700/112; 700/105; 359/822; 385/53; 385/94

(58) Field of Classification Search ..... 700/95, 700/97, 105, 112, 117; 312/223.1–223.3; 359/245, 822; 385/53, 88–94
See application file for complete search history.

(56) References Cited

U.S. PATENT DOCUMENTS 4,230,902 A 10/1980 Hug et al.
4,757,239 A * 7/1988 Starkey, IV ..... 315/371
4,918,928 A * 4/1990 Morioka et al. ..... 62/51.1
5,181,304 A 1/1993 Piotrowski
5,455,458 A 10/1995 Quon et al.
5,455,709 A * 10/1995 Dula et al. ..... 359/245
5,521,999 A * 5/1996 Chuang et al. ..... 385/88
5,637,175 A * 6/1997 Feygin et al. ..... 156/264
5,733,024 A * 3/1998 Slocum et al. ..... 312/223.2
5,944,329 A 8/1999 Salzer et al.
6,069,752 A * 5/2000 Harrigan et al. ..... 359/822
6,098,264 A 8/2000 Harrigan et al.
6,307,871 B1 10/2001 Heberle
6,391,442 B1 5/2002 Duvall et al.
6,570,895 B2 5/2003 Heberle
6,620,515 B2 9/2003 Feng et al.
6,764,759 B2 7/2004 Duvall et al.

(Continued)

FOREIGN PATENT DOCUMENTS

JP 11104983 6/1997

(Continued)

*Primary Examiner*—Crystal J Barnes-Bullock
(74) *Attorney, Agent, or Firm*—Haynes and Boone, LLP

(57) ABSTRACT

In accordance with at least one embodiment of the present invention, a manufacturing system includes a factory system and a field system. The factory system includes a first mount configured to receive, support, and precisely locate a removable line replaceable unit (LRU) having one or more components at a first factory LRU station within the factory system. The received LRU components are capable of adjustment to configure proper operation of the received LRU within the factory system. The field system corresponds to the factory system and includes a second mount configured to receive, support, and precisely locate an LRU removed from the factory system at a first field LRU station corresponding to the first factory LRU station. The removed and received LRU is configured for proper operation within the field system without adjustment of the one or more LRU components.

24 Claims, 12 Drawing Sheets

U.S. PATENT DOCUMENTS

| | | | | |
|---|---|---|---|---|
| 6,793,494 | B2 * | 9/2004 | Varshneya et al. | 434/21 |
| 6,815,486 | B2 | 11/2004 | Bhagwagar et al. | |
| 6,848,500 | B1 | 2/2005 | Langari et al. | |
| 7,165,123 | B2 * | 1/2007 | Hindman | 710/3 |
| 7,496,587 | B2 * | 2/2009 | Odemann | 707/101 |

FOREIGN PATENT DOCUMENTS

| | | |
|---|---|---|
| JP | 2004069400 | 5/2002 |
| WO | WO 2005/017064 | 2/2005 |

* cited by examiner

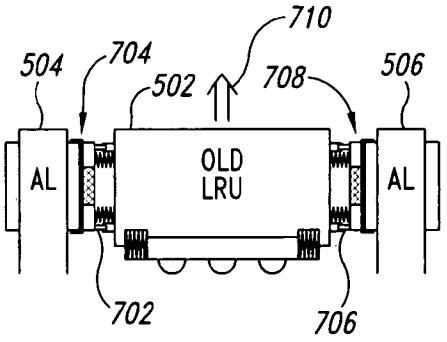
Fig. 5
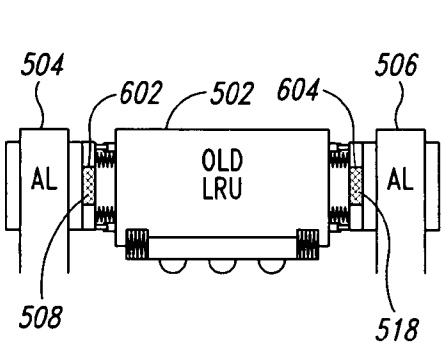
Fig. 6
Fig. 7
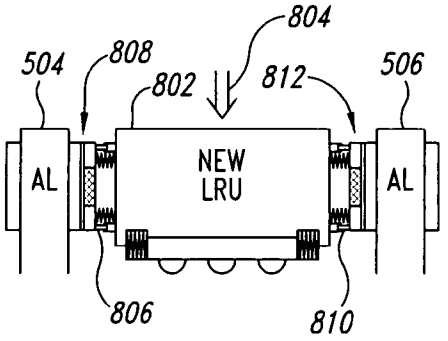
Fig. 8
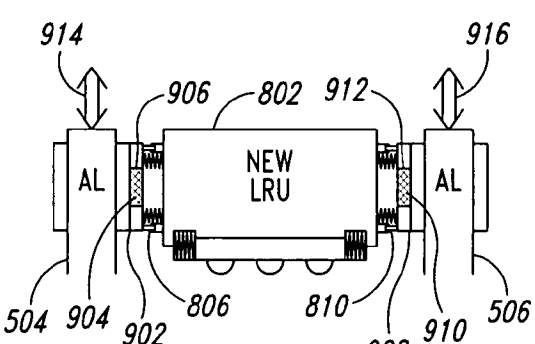
Fig. 9
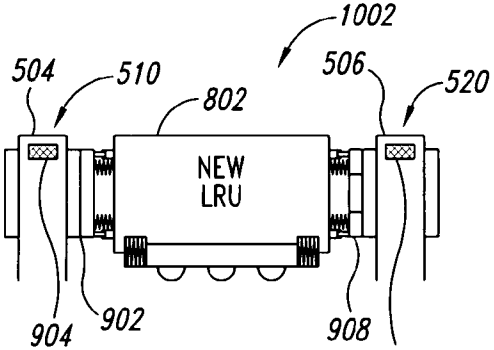
Fig. 10

LINE REPLACEABLE SYSTEMS AND METHODS

TECHNICAL FIELD

The present invention relates generally to the design and maintenance of complex and/or delicate systems, and more particularly, for example, to line replaceable systems and methods.

RELATED ART

As the level of sophistication of field operated, or fielded systems has increased, so has the logistical burden of maintaining these fielded systems that may require maintenance under harsh conditions. In particular, the deployment of some technologies to a fielded environment is impeded by this difficulty. Some fielded systems and/or components may require complex and often time-consuming maintenance procedures that may be extremely difficult or impossible to accomplish in a Spartan forward location such as a battlefield. For example, a laser weapon system may include optical components or sub-systems that require careful adjustments including alignment, calibration and/or testing prior to activation. Such adjustments may be impossible in a remote environment so that deployment of the laser weapon system is prevented. Currently, many optical systems are much too complex and fragile for application in a remote location, because they often require highly-trained personnel for operation, require precision setup and calibration, and require extensive preparation of the surrounding area to prevent contamination and damage. Further, laser optical systems typically must be kept extremely clean, imposing an additional support requirement for environmental control equipment around the optics.

FIG. 1 shows a traditional approach of using a clean room facility 100 to protect optical system components, where an optical table 102 supporting the optical system components is surrounded by a re-sealable, optical table enclosure 104 equipped with a lid and/or door 106 to provide access to an enclosure interior region. Enclosure 104 provides environmental and vibration isolation for the optical system composed of individually mounted and maintained optical elements. Enclosure 104 is typically surrounded by a tent or curtain 108 and placed within a clean room 110 that receives a supply of filtered air through a Heating Ventilation and Air Conditioning (HVAC) system 112 equipped with one or more High Efficiency Particulate Air (HEPA) filters.

A local infiltration control apparatus may be used within tent 108 for use in maintenance operations. Clean room 110 can maintain cleanliness through a combination of surface decontamination and the use of air filtration. A technician 114 or other personnel can move from an exterior region 116, outside the clean room facility 100, into an airlock (AL) 118 and into the clean room interior region 120. Airlock 118 may include an air shower with a moderate flow of air used to cleanse technician 114 and/or purge the possibly contaminated air from airlock 118. Technician 114 may be required to wear specialized clothing and/or observe specialized cleaning provisions to limit the importation of dust and/or other contaminants from exterior region 116 into interior region 120. Specialized clothing and/or cleaning materials may be stored in an accessible space 122, such as a clothing locker, so that technician 114 may don the specialized clothing within airlock 118 prior to entering clean room 110.

Special equipment and training is required for operations related to optical table 102, such as installation, alignment calibration and testing due to the typically complex and difficult process required for accessing or maintaining the optical components. These strict requirements place a burden in effort and time upon technician 114 prior to gaining access to optical table 102 within enclosure 104, including entering and leaving clean room 110. Such environmental and procedural requirements may not be easily adapted to a remote or harsh environment, and would likely require significant additional equipment and space to implement. In view of these issues and others, there remains a need in the art for less complex methods and systems that enable the deployment and maintenance of sophisticated and/or delicate systems for use in a fielded environment.

SUMMARY

Systems and methods are disclosed herein, in accordance with one or more embodiments of the present invention related to providing a parallel manufacturing system, eliminating a clean room requirement while maintaining an optical system, designing and deploying an advanced optical system design, providing a simplified design methodology that enables the field operation and maintenance of precision optical systems, and/or an application to a tactical High Energy Laser (HEL) Weapon System. A factory system provides a master configuration for the mounting of removable line replaceable units (LRUs), and this configuration is precisely transferred through mounts and tooling to one or more field systems.

More specifically in accordance with an embodiment of the present invention, a manufacturing system includes a factory system and a field system. The factory system includes a first mount configured to receive, support, and precisely locate a removable LRU having one or more components at a first factory LRU station within the factory system. The received LRU components are capable of adjustment to configure proper operation of the received LRU within the factory system. The field system corresponds to the factory system and includes a second mount configured to receive, support, and precisely locate an LRU removed from the factory system at a first field LRU station corresponding to the first factory LRU station. The removed and received LRU is configured for proper operation within the field system without adjustment of the one or more LRU components.

In accordance with another embodiment of the present invention, a line replaceable unit (LRU) includes a table member and an environmental enclosure. The table member has a first side and a second side. The table member first side is configured to support at least one LRU component while the table member second side is configured to mate with a mount in one of a factory system and a corresponding field system. The environmental enclosure surrounds an LRU interior region including at least a portion of the table member. The LRU environmental enclosure has a first port and a second port. The LRU first port is configured to receive a first isolation plug or cover for effectively sealing the first port. The LRU second port is configured to receive a second isolation plug for effectively sealing the second port. The LRU interior region is effectively isolated when both the first and second ports are sealed.

In accordance with another embodiment of the present invention, a maintenance method includes the operations of positioning a line replaceable unit (LRU) including one or more components in the field system on a mount adjacent to a first air lock (AL) and a second AL. The LRU includes an environmental enclosure surrounding an LRU interior region and has an LRU first port and an LRU second port. The first AL includes an environmental enclosure surrounding a first AL interior region and has a first AL first port and a first AL second port, while the second AL includes an environmental enclosure surrounding a second AL interior region and has a second AL first port and a second AL second port. The mount is configured to receive, support, and precisely locate the positioned LRU for proper operation within the field system without adjustment of the one or more LRU components. The method further includes the operation of connecting the LRU first port to the first AL second port to form a first air-tight conduit between the LRU and the first AL, and connecting the LRU second port to the second AL first port to form a second air-tight conduit between the LRU and the second AL. At least one of the LRU first port and the first AL second port include a seal to prevent communication between the LRU and the first AL, while at least one of the LRU second port and the second AL first port include a seal to prevent communication between the LRU and the second AL. The method further includes decontaminating the first AL interior region and the second AL interior region, removing one or more seals from between the first AL and the LRU to permit communication between the first AL and the LRU, and removing one or more seals from between the second AL and the LRU to permit communication between the second AL and the LRU. The first air-tight conduit forms an air-tight communication path between the first AL and the LRU, while the second air-tight conduit forms an air-tight communication path between the second AL and the LRU.

The scope of the present invention is defined by the claims, which are incorporated into this section by reference. A more complete understanding of embodiments of the present invention will be afforded to those skilled in the art, as well as a realization of additional advantages thereof, by a consideration of the following detailed description. Reference will be made to the appended sheets of drawings that will first be described briefly.

BRIEF DESCRIPTION OF THE DRAWINGS

FIG. 5 through FIG. 10 illustrate a sequence of views showing an exemplary removal and replacement of an LRU according to an embodiment of the present invention.

Embodiments of the present invention and their advantages are best understood by referring to the detailed description that follows. It should be appreciated that like reference numerals are used to identify like elements illustrated in one or more of the figures.

DETAILED DESCRIPTION

One or more embodiments of the present invention are drawn to one or more systems and/or methods related to a parallel manufacturing system, elimination of a clean room requirement for maintaining an optical system, an advanced optical system design, and/or an application to a tactical or strategic High Energy Laser (HEL) Weapon System. In accordance with one or more embodiments of the present invention, a plurality of Line Replaceable Units (LRUs) may be manufactured and installed without expensive preparations and training, according to military specifications and while satisfying mission requirements. Although reference is made to weapon systems and high-energy optical systems, other applications of embodiments of the present invention may include communications, surveillance, and medical devices or systems, for example.

Parallel Manufacturing System

Figure 1:
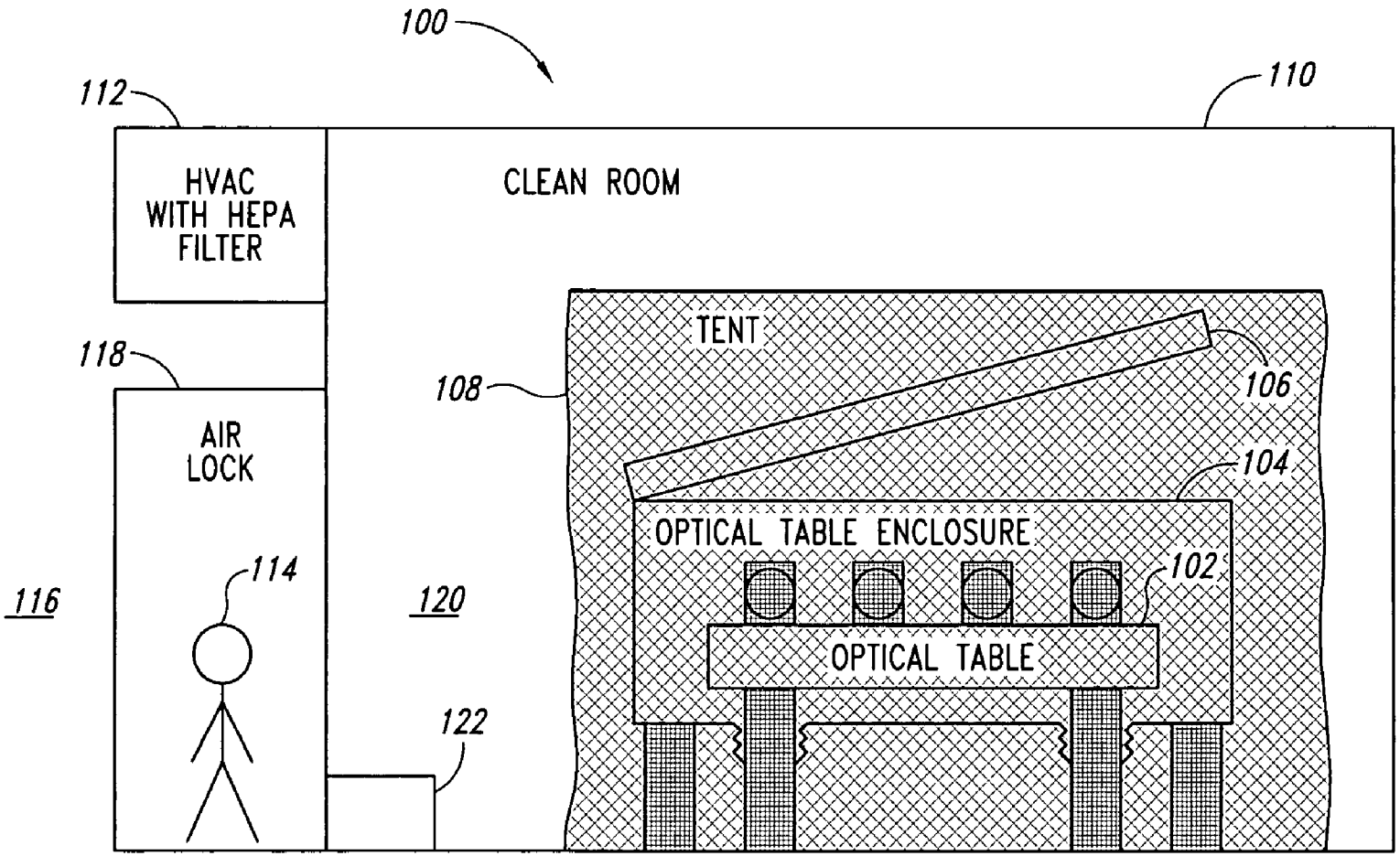
Fig. 1 (Prior Art)
FIG. 1 shows a side plan view of a traditional clean room facility where a technician is gaining access to a clean room housing an optical table.
Figure 2:
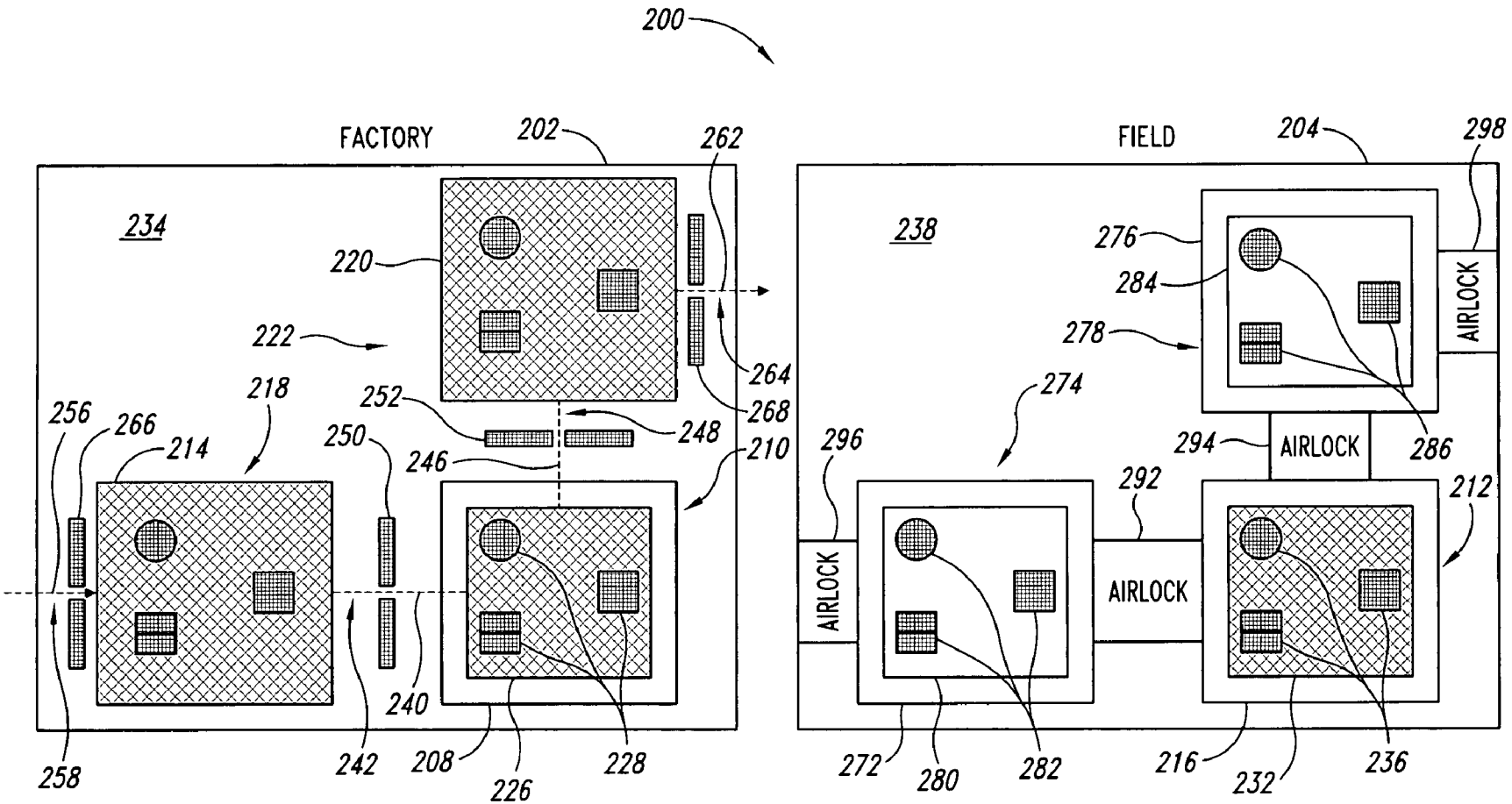
FIG. 2 shows a block diagram view of an exemplary embodiment of a parallel manufacturing system including a factory system and a corresponding field system, in accordance with an embodiment of the present invention.

FIG. 2 shows a block diagram view of an exemplary embodiment of a parallel manufacturing system 200 including a factory system 202 and at least one corresponding field system 204. A line replaceable unit (LRU) 208, comprising an operational portion of factory system 202, may be precisely located at a first factory LRU station 210 in factory system 202. LRU 208 may be prepared through proper calibration, adjustment, and/or configuration to operate within factory system 202. Once LRU 208 is prepared, LRU 208 may be removed from factory system 202 and installed in field system 204 in a first field LRU station 212 corresponding to the position of first factory LRU station 210 so that LRU 208 may operate within field system 204 without adjustment. Furthermore, LRU 208 may be adjusted to proper tolerances and specifications including calibration of positions, tolerances, and/or levels while operative with factory system 202, then the adjusted LRU 208 may be transferred into field system 204 to operate without adjustment. Another LRU 216 may already be present within field system 204 at first field LRU station 212 and would be removed prior to the insertion of LRU 208. In this manner, LRU 208 may be considered a new LRU while LRU 216 may be considered an old LRU that is in need of replacement for any reason including defective operation, planned maintenance, troubleshooting, or a change in the operational requirements of field system 204.

Although LRU 208 and LRU 216 may be designed to perform identical functions within identical parameters, such is not a requirement. Instead, LRU 208 may simply be calibrated to properly interact with the rest of system 202 while performing a particular function or exercising a particular capability that is different from one or more functions and/or capabilites of LRU 216. For example, LRU 208 may replace LRU 216 in field system 204 due to a change in operational requirements where LRU 208 has one or more different capabilities than LRU 216 such as differences including cycle time, operating frequency, and/or power output level. In one embodiment, factory system 202 can be, for example, a laboratory version of an operationally identical field system 204 for deployment in a remote or hostile environment. Field system 204 may be an optical system, such as a laser weapon system, including one or more subsystems having optical components (e.g. elements and/or sensors) mounted on a plurality of separate optical tables that are precisely aligned in relative position to each other to permit light beams, for example, to pass between elements located on one or more of the optical tables. The mounting stations for the LRUs in field system 204 are made to precisely reproduce or conform to the configuration of factory system 202. This may include a transfer of the mount location as well as reference tooling to verify that the locations are as specified, so that factory system 202 may be considered the original or master in this process while a plurality of field systems 204 may be considered as copies or slaves.

In accordance with one embodiment, factory system 202 may include a first reference table 214 at a second factory LRU station 218, an LRU 208 at a first factory LRU station 210, and/or a second reference table 220 at a third factory LRU station 222. LRU 208 may contain or support an optical table 226 on a kinematic mount (KM) 228 that may be supported by an optical bench 234 or other platform. KM 228 may include a plurality of mount elements that may utilize, for example, the interaction between a series of set screws and at least one cone, groove, and planar surface to make angular, translational, and/or elevational (height) adjustments to precisely locate optical table 226 in a three-dimensional spatial relation to the adjacent reference tables (214, 220). In this manner, LRU 208 is precisely located in a first relative position within factory system 202. Although a KM is preferred, other mounting methods and/or systems may be used.

In the same manner, LRU 216 may contain or support an optical table 232 on a KM 236 that is supported by an optical bench 238. KM 236 is configured to support optical table 232 and/or LRU 216 in a precise, relative position within field system 204 that is identical to the relative position of LRU 208 within factory system 202. First reference table 214, optical table 226, and/or second reference optical table 220 can include or support any portion including an entirety of an optical system, including an optical subsystem with a collection of optical elements and/or sensors configured to perform a particular function or sub-function as a part of factory optical system 202.

During operation of factory optical system 202, at least one beam of light 240 may pass between first reference table 214 and optical table 226 along an optical path 242, and at least one beam of light 246 may pass between optical table 226 and second reference table 220 along an optical path 248. Precise orientation of LRU 208 may be required for the proper operation of factory system 202 so that the inter-table optical paths (242, 248) are properly aligned. One or more alignment reference fixtures, targets and/or optical tools (250, 252) may be mounted on, in, or between adjacent optical tables (214, 226, 220) to measure the light beams (242, 246) and/or for use in refining position of one or more components and/or elements supported on LRU 208. It is assumed, in this case, that the component and/or element orientation on each of the reference tables (214, 220) are set, and that only the configuration of components on LRU 208 would be adjusted in order to properly interact with the reference table components.

In one embodiment, factory optical system 202 may receive an external light beam 256 from an external source such as a laser emitter or another optical system along an optical path 258 and may emit an output light beam 262 along an optical path 264. Alternatively, light beams may be either received or emitted along the optical paths defined by light beams (242, 248, 258, 264). Conversely, if factory optical system 202 relates to an optical system that does not receive or emit light externally, either or both external light beams (256, 262) may not be present. If external light beams are received or emitted, one or more reference fixtures, alignment targets, and/or optical tools (266, 268) may be mounted at peripheral locations to measure the light beams (216-3, 216-4) received and/or sent, respectively. Further, reference fixtures (266, 262) may be used to refine or confirm the proper orientation of one or more elements on one or more reference tables (214, 220). LRU 208, or an identically aligned LRU, may be repeatedly removed and replaced upon KM 228 while assuming a precise placement in factory optical system 202 within the system tolerances. First reference table 214 and/or second reference table 220 may each be mounted on separate kinetic mounts, but it is not necessary. In this case, factory system 202 may include one or more LRU modules configured to replace either first reference table 214 and/or second reference table 220.

Field system 204 can be a field or ruggedized version of a factory system 202, such as a laser weapon system, which includes a plurality of subsystems with components mounted on one or more separate, but precisely aligned LRUs. In accordance with one embodiment, field system 204 may include an LRU 216 configured for placement at first field LRU station 212, an LRU 272 configured for placement at a second field LRU station 274, and a third LRU 276 configured for placement at a third field LRU station 278. LRU 272 may contain or support an optical table 280 on a KM 282 to precisely place LRU optical table 280 in relation to an adjacent LRU optical table 232 and possibly an external light beam (not shown). Similarly, LRU 276 may contain or support an LRU optical table 284 on a KM 286 to precisely locate LRU optical table 284 in relation to an adjacent LRU optical table 232 and possibly an different external light beam (not shown). Finally, LRU 216 may contain or support optical table 232 on a KM 236 to precisely locate LRU optical table 232 in relation to the adjacent LRU optical tables (280, 284). In this manner, the KMs in field system 204 precisely reproduce the positioning of the corresponding LRUs established by the KMs in factory system 202. For example, an LRU 208 aligned on KM 228 in factory system 202 is also aligned on KM 236 in field system 204.

Inter-module air locks (ALs) (292, 294) provide a controlled or sealed environment for passing light between LRU optical tables 232 and the adjacent LRU optical tables (280, 284). Similarly, peripheral ALs (296, 298) provide a controlled environment for passing light either into or out of field system 204. The controlled environment can be an air-filled contaminant free space, an evacuated space, or a space filled with an inert gas such as nitrogen or helium, or other selected gas, for example. In this example, inert means less-reactive in at least one desired manner, such as inhibiting oxidation by displacing oxygen or inhibiting corrosion by displacing or absorbing water vapor, or inhibiting optical breakdown at a point of focus, for example. The inert gas may be active in some other fashion.

During operation of field optical system 204, at least one beam of light may pass between LRU optical table 232 and LRU optical table 280. Similarly, at least one beam of light passes between LRU optical table 232 and LRU optical table 284. Precise placement and orientation of LRU optical tables (232, 280, 284) may be required for the proper operation of field system 204. In this embodiment, any LRU (216, 272, 276) may be removed and promptly replaced with a corresponding LRU calibrated in an embodiment of factory system 202 for use without adjustment, without expensive preparations or requiring extensive training for maintenance personnel, and according to military or other specifications and while satisfying mission and/or performance requirements such as Mean Time To Repair (MTTR) and other supportability issues.

First reference table 214 and second reference table 220 may be considered as surrogates since they take the place of the corresponding LRU tables in field optical system 204. Alternatively, any corresponding LRU, component, and/or module in factory system 202 may be considered as a surrogate for a corresponding LRU, component, and/or module in field system 204. In this manner, the description of manufacturing system 200 discloses an alignment method that transfers a manufacturing facility geometry and/or relative layout to a field system based on interchangeable LRU assemblies through the use of surrogates. One or more LRUs may then be transferred from factory system 202 to field system 204 where the corresponding kinematic mounting transfers the internal and external alignments established during manufacturing to the field without the need for realignment, so that alignment and calibration in the field are not required or are greatly reduced. The automatic alignment of an interchangeable LRU or other element may be considered a self-registration process where a fully seated table or element assumes the proper orientation due to interaction with a corresponding kinetic mount. Identically aligned LRUs may be manufactured and shipped to a field system 204 location, such as a battlefield, repair depot, or other remote location from the factory where a simple field installation process may be used when the need for replacement arises. Such a replacement may be deemed necessary due to a component failure, component degradation, a change in alignment or mission requirements, and/or due to maintenance. In this manner, the locating points (e.g. kinetic mounts) for field system 204 are configured to match factory system 202, so that an LRU adjusted to operate properly within factory system 202 may be transferred to a corresponding locating point within field system 204 and operate without location adjustment.

As will be discussed more fully below, embodiments of the present invention address and eliminate the need to open and/or disassemble sensitive or delicate optical enclosures in order to repair or maintain precision optical systems. Further, embodiments of the present invention address the problem of how to accomplish field maintenance with replacement of optical components and/or line-replaceable-assemblies (LRAs) without requiring specially trained technicians using delicate optical alignment and calibration instrumentation to realign the system after inspection or maintenance after replacement. Although embodiments of the present invention are drawn to an optical system, the disclosed substitution of pre-calibrated tables or sub-systems may apply to other many applications such as non-optical instrumentation, seismological measurement devices, biochemical field testing systems, and/or space communication ground stations.

In more detail, an optical system in accordance with one or more embodiments of the present invention may include one or more of the following properties. First, the optical system is designed and manufactured with strict tolerances, selected structural material, and precision self-registration and/or self-diagnosis capabilities in order to better withstand the rigors of remote operations and harsh field conditions such as associated with a military deployment. Structural components of the optical system may be designed using materials with opposing thermal properties to compensate for thermally induced distortions, and active optical components may be designed with dynamic compensators to significantly reduce or eliminate self-induced vibration and/or jitter. All LRU replaceable elements may be mounted upon kinematic mounts using various attachment means and/or techniques to eliminate or minimize torque-induced distortion to the precision optics such as bolts that pass through the center of registration or mating surfaces, for example. The mounting bolts may also use spherical, self-centering washers to eliminate residual lateral shear forces that may result from an imperfect placement of the mounting bolts.

A second property of a system in accordance with at least one embodiment of the present invention includes a system that may be aligned in a factory setting using precision alignment and calibration references that are maintained to exacting configuration standards prior to delivery to a field or remote site. Since each LRU may be designed with built-in diagnostics to assess its alignment validity, each LRU can be assembled, integrated and aligned to the factory reference standards where the built-in diagnostics may be aligned and calibrated accordingly. The built-in diagnostics may monitor the performance of the LRU and alert the field operator when maintenance or replacement of the LRU is required.

A third property of a system in accordance with at least one embodiment of the present invention includes a system where at least some of the optical elements of the LRUs are aligned and referenced to the optical tables internal to the LRU. The optical tables may be attached to a common optical bench or benches through kinematic mounts that assure proper assembly without distortion that could affect the relative alignment of the optics. In this manner, the common optical bench may be considered as a primary reference to which all the field optical elements are registered and/or aligned. A duplicate optical bench in the factory facility may be considered a secondary reference for the factory optical elements. Optical elements may be mounted to one or more optical tables attached to one or more kinematic mounts, allowing alignment of the optical elements in the factory system using appropriate tools prior to shipping, then that alignment may be reproduced in the field system using the kinematic mounts. Vibration and position isolation can optionally be provided around the attachment points between the LRUs and ALs and between the optical tables within the LRU and the LRU support structure. The ALs may provide mechanical support to vacuum and/or environmental modules supporting the LRUs.

A fourth property of a system in accordance with at least one embodiment of the present invention includes a functional duplicate of the complete field optical system, including the original alignment and calibration reference system maintained in the factory for subsequent alignment and calibration of the LRU for field use. In other words, the exact alignment and calibration configuration of the field unit is maintained in the factory. In this manner, the field requirement for precision alignment and calibration is transferred from the field and maintained in the factory. Any replacement LRU could be pre-aligned to the replicated optical system in the factory using precision alignment and/or calibration processes. Field personnel merely replace a desired LRU and allow the substituted unit to self-register to within optical tolerances, and bolt down the substituted unit using the kinematic mounts which do not distort system optical alignment when torque is applied. In this manner, the alignment of the relevant kinematic mounts then transfers and registers the LRU alignment from the factory to the field.

The properties and/or benefits described above can provide position stability and/or position controllability. In more detail, one or more embodiments of the present invention provide position stability since the optical tables within the LRUs can be attached to a common optical bench or benches through kinematic mounts that assure assembly without distortion that may negatively affect the proper relative alignment of the mounted optics. Furthermore, optical elements can be mounted to optical tables that can be attached to the kinematic mounts, allowing positioning prior to shipping using appropriate tools followed by the reproduction of that alignment in the field using the precisely aligned kinematic mounts. Vibration and position isolation can be provided around the attachment points between the LRUs and ALs and between the optical tables within the LRU and the LRU structure.

The air locks (ALs) may provide mechanical support to the vacuum or environmental containers or modules containing the LRUs, while each LRU may include expansion members located between the optical table and the environmental containers to prevent vacuum and/or pressure loads from being transmitted to the optical table and affecting alignment. Further, one or more embodiments of the present invention provide position controllability since the interchangeable modules are constructed such that the optical elements contained within each module may be aligned as an assembly or subassembly with respect to the entire optical system remotely and without breaching of an environmental control barrier when the modules are installed correctly using the kinetic mounts and fastening hardware. The provision of position stability and position controllability provides at least the benefits of increasing the availability of complex and delicate systems in a field environment, such as a laser weapon deployed in a remote site, while reducing the logistics burden or footprint required in maintaining such a system.

System Design and Elimination of a Clean Room Requirement

Figure 3:
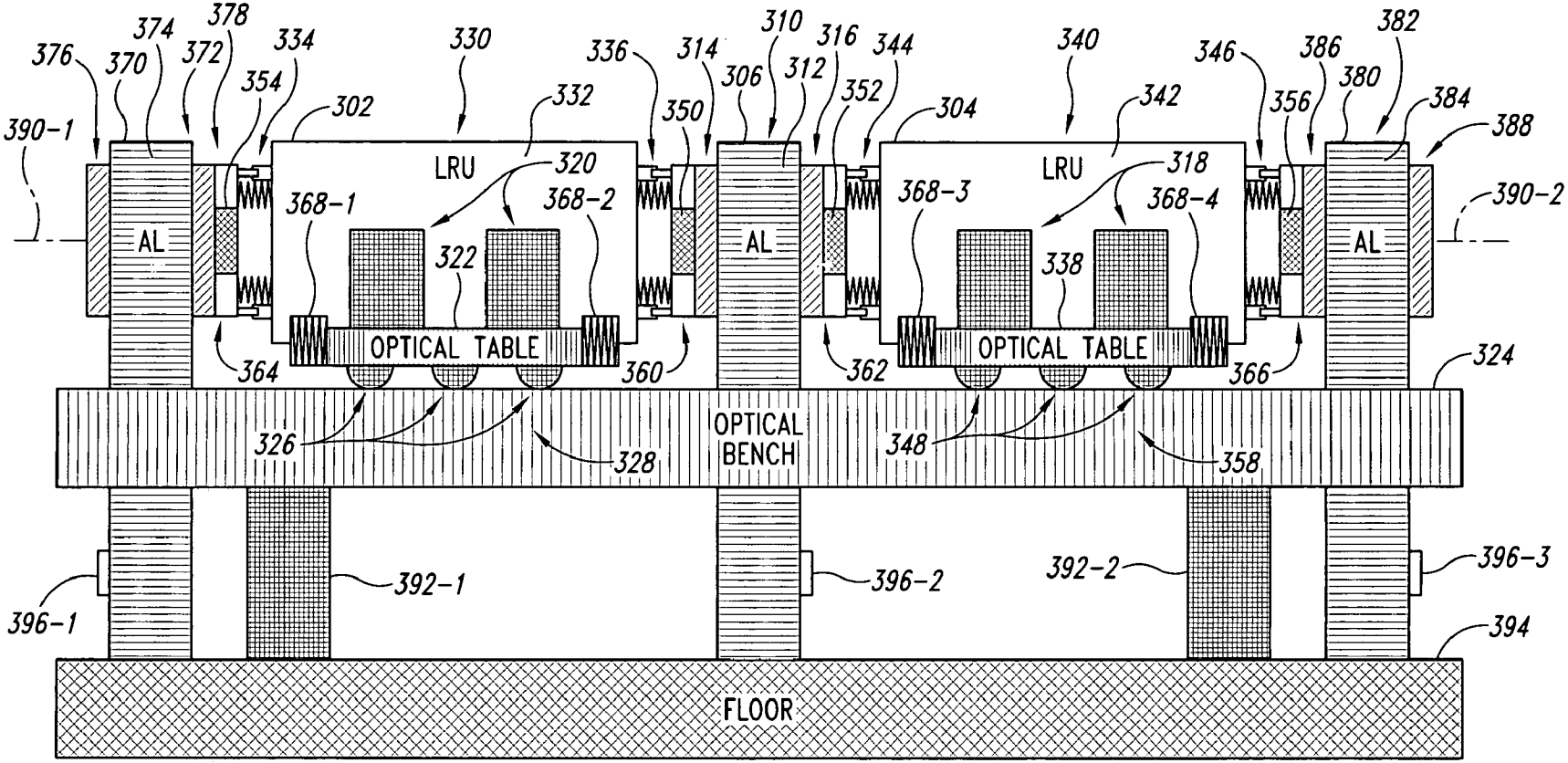
FIG. 3 shows a side plan view of an exemplary embodiment of a field optical system, according to an embodiment of the present invention.

In reference to FIG. 3, one or more embodiments of the present invention may be drawn to a system design and elimination of a clean room requirement for use with sensitive optics and/or equipment. FIG. 3 shows a side plan view of a field optical system 300 that is an exemplary embodiment of field system 204, as shown in FIG. 2. FIG. 3 can be, for example, a high-power precision optical system including line replaceable units (LRUs) (302, 304) connected to and separated from each other by an intermediate air lock (AL) 306 that may include an environmental enclosure 310 surrounding an interior AL region 312 and having a first port 314 and a second port 316. Enclosure 312 is environmentally closed except for the openings provided by first port 314 and second port 316. Enclosure 312 may include a user access port (FIG. 11) that provides a user access to AL interior region 312.

LRU 302 may include an environmental enclosure 330 surrounding an LRU interior region 332 and having a first port 334 and a second port 336. Similarly, LRU 304 may include an environmental housing 340 surrounding an LRU interior region 342 and having a first port 344 and a second port 346. AL 306 first port 314 can be releasably connected with LRU 302 second port 336 in order to form a first air-tight conduit 360. Similarly, AL 306 second port 316 may be releaseably connected with LRU 304 first port 344 to form a second air-tight conduit 362. In this manner, the LRU interior region 332, AL interior region 312, and LRU interior region 342 are connected to form a piecewise continuous environmental enclosure. Similarly, an AL 370 may include an environmental enclosure 372 surrounding an interior AL region 374 and having a first port 376 and a second port 378. AL 370 second port 378 can be releasably connected with LRU 302 first port 334 in order to form a third air-tight conduit 364. AL 370 first port 376 can be releasably connected with another LRU (not shown), another AL (not shown), and/or be left open to receive a light beam 256 (FIG. 2) from an external source, for example.

Further, an AL 380 may include an environmental enclosure 382 surrounding an interior AL region 384 and having a first port 386 and a second port 388. AL 380 first port 386 can be releasably connected with LRU 304 second port 346 in order to form a third air-tight conduit 366. AL 380 second port 388 can be releasably connected with another LRU (not shown), another AL (not shown), and/or be left open to emit a light beam 262 (FIG. 2) from an external destination, for example. Additionally, wires, optical fibers, and/or mechanical linkages may be passed to and between LRU 302 and LRU 304 through AL 306. AL 370, LRU 302, AL 306, LRU 304, and AL 380 may be aligned in a linear fashion where the respective ports and interior regions define a piecewise continuous environmental enclosure along a beam path (390-1, 390-2). A laser beam may follow beam path (390-1, 390-2) through the interior portion of the enclosure. Each AL and/or LRU may include more or fewer than two ports, and the ports may not be collinear.

In addition to providing a continuous communication between LRU 302 and LRU 304, AL 306 can selectively provide mutual environmental isolation of LRU 302 from LRU 304, and vice versa. A first LRU isolation plug 350 that may be installed in first conduit 360 to environmentally seal the passageway between LRU 302 and AL 306 so that no air or contaminants may pass between LRU 302 and AL 306. Similarly, AL 306 may include a second LRU isolation plug 352 that may be installed in second conduit 362 to environmentally seal the passageway between LRU 304 and AL 306 so that no air or contaminants may pass between LRU 304 and AL 306. LRU 302 may be isolated on a side opposite AL 306 by installing a third isolation plug 354 in third conduit 364, and LRU 304 may be isolated on a side opposite AL 306 by installing a fourth isolation plug 356 in fourth conduit 366. Any of the isolation plugs (350, 352, 354, 356) may be moved from their installed positions to restore an open communication through the associated conduit or passageway. Isolation plugs (350, 352, 354, 356) preferably have a circular cross section, but may have a rectangular or other geometrical cross section depending on the application. As will be discussed in reference to FIG. 12, each port may be separately sealed using an isolation plug so that each conduit may be blocked or closed by a pair of isolation plugs. In this manner, neither the LRU nor the adjacent AL may become contaminated when the juncture forming the intermediate conduit is opened.

In reference to FIG. 3, LRU 302 may include a plurality of optical elements and/or sensors 320 mounted on an optical table 322. When both first isolation plug 350 and third isolation plug 354 are installed, LRU 302 is environmentally closed, and thereby isolated from outside air and other contaminants. LRU 302 may be mounted upon an optical bench 324, or other support, using a plurality of mounting members 326 comprising a kinematic mount 328 that is an exemplary embodiment of KM 282 as described in reference to FIG. 2. Similarly, LRU 304 may include a plurality of optical elements and/or sensors 318 mounted on an optical table 338. When both second isolation plug 352 and fourth isolation plug 356 are installed, LRU 304 is environmentally closed, and thereby isolated from outside air and other contaminants. LRU 304 can be mounted upon optical bench 324 using a plurality of mounting members 348 comprising a kinematic mount 358 that is an exemplary embodiment of KM 236 as described in reference to FIG. 2. As mentioned above, each port may each be separately sealed using an individual isolation plug.

In one embodiment, light may pass to and between the optical elements (318, 320) and/or sensors mounted on the plurality of optical tables (322, 338). LRU 302 first port 334 may include a flexible clearance control or load path capable of extending or retracting to mate with and/or release from a corresponding portion of an adjacent air lock, such as AL 370 second port 378. Similarly, LRU 302 second port 336 may include a flexible clearance control or load path capable of extending or retracting to mate with and/or release from a corresponding portion of an adjacent air lock, such as AL 306 first port 314. In this manner, LRU 302 first port 334 and LRU second port 336 may retract away from their adjacent AL (370, 306) so that LRU 302 may be removed from KM 328. In like manner, LRU 304 first port 344 and second port 346 may retract away from their adjacent AL (306, 380) so that LRU 304 may be removed from KM 358. Vibration isolation elements (368-1, 368-2) may optionally be included in LRU 302 in order to dampen environmental vibrations that could be communicated to optical table 322. Similarly, vibration isolation elements (368-3, 368-4) may optionally be included in LRU 304 in order to dampen environmental vibrations that could be communicated to optical table 338. For a non-collinear arrangement of elements, this may be preferred to facilitate the removal and/or replacement process without requiring one or more flexible joints. Optical bench 324 may be mounted upon a plurality of positioning and vibration isolation supports (392-1, 392-2) resting upon a floor 394 or other surface. Floor 394 can be part of a mobile platform such as a mobile weapon system or combat vehicle. Alternatively, floor 394 can be a part of a fixed platform such as a fixed building floor, or the earth. ALs (370, 306, 308) may include a one-way vent valve (396-1, 396-2, 396-3) to permit pressurized gas to escape from within either the individual AL or from any portion of piecewise continuous chamber comprised of one or more AL and LRU alternately connected segments. Although optical bench 324 is shown in a preferable horizontal orientation, this position is not considered limiting. Any portion of optical bench 324 may alternatively be vertically mounted or disposed at any angle, including an orientation where the LRUs are supported in an upside down position. Once attached, LRUs mounted upon their associated mounting location may be supported against movement in any dimension away from their mounted position.

Figure 4:
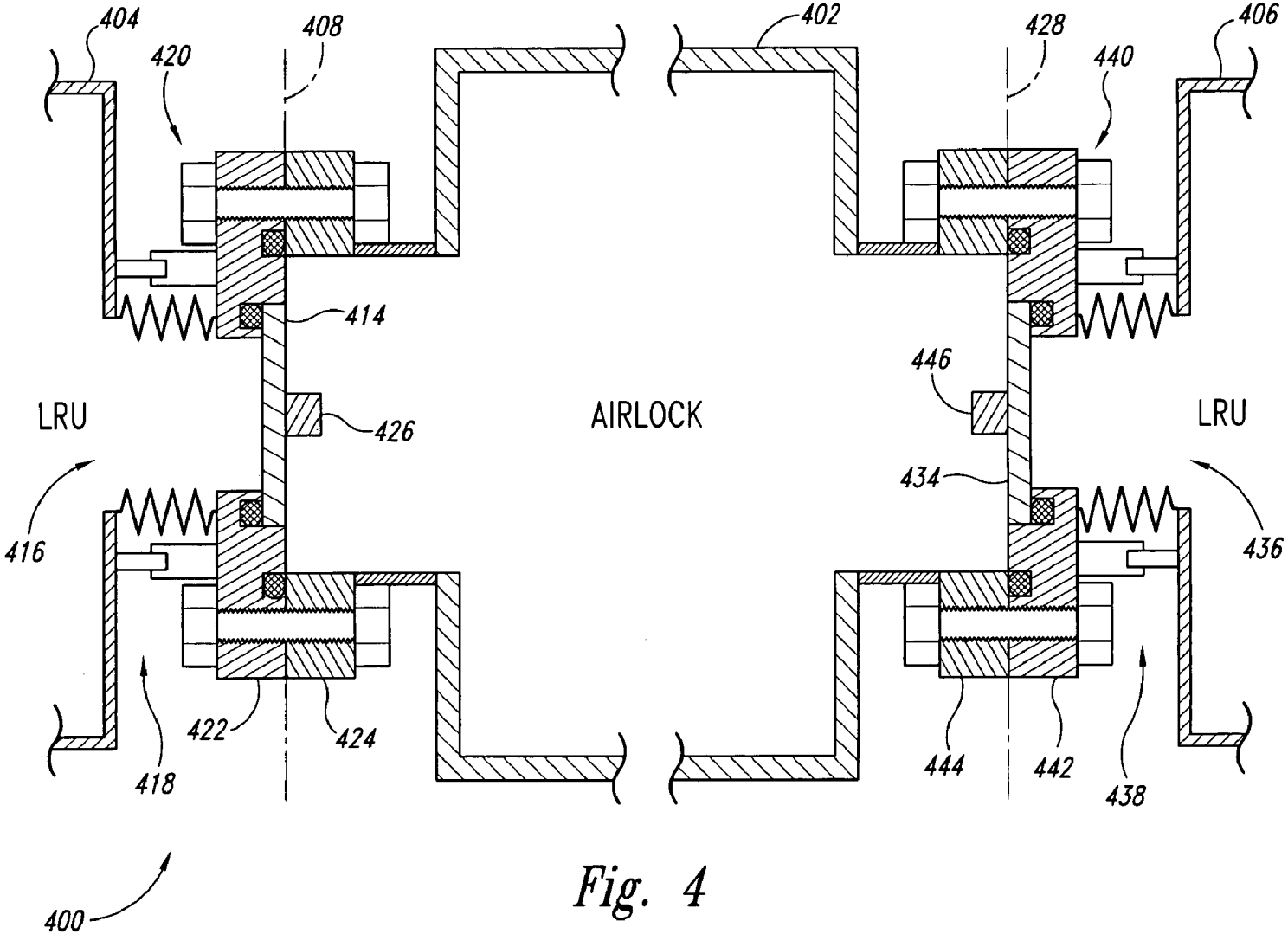
FIG. 4 shows a top plan view of an exemplary portion of a field system including an air lock (AL) connected to adjacent Line Replaceable Units (LRUs), according to an embodiment of the present invention.

FIG. 4 shows a top plan view of an exemplary portion of a field system 400 including an air lock (AL) 402 connected to adjacent Line Replaceable Units (LRUs) (404, 406) according to an embodiment of the present invention. AL 402 is configured to mate with LRU 404 along a mating surface 408 that may include planar and/or interlocking mating surfaces. Isolation plug 414 is an exemplary embodiment of isolation plug 308 as shown in reference to FIG. 3. In this embodiment, an isolation plug 414 mates with a portion of LRU 404 to seal a passageway 416 into LRU 404. Isolation plug 414 can be an exemplary embodiment of isolation plug 350 shown in FIG. 3. In this manner, passageway 416 into LRU 404 is environmentally closed and neither air nor other contaminants may enter through the closed passageway 416. LRU 404 may preferably include a flexible clearance control or load path 418 that provides flexible mating between AL 402 and LRU 404 at a mating region 408 to form an air-tight seal. Conversely, the seal along mating region 408 can be broken to separate AL 402 and LRU 404. Flexible path 418 is configured to move in a telescoping manner towards and away from the corresponding juncture with AL 402. Alternatively, AL 402 may include a flexible path (not shown) which mates with LRU 404 flexible path 418.

A locking and/or sealing mechanism 420 can include one or more bolts or other fasteners for retaining a flange 422 of LRU 402 against a corresponding flange 424 of AL 402. As shown, isolation plug 414 mates with a portion of flange 422 so that LRU 404 can remain closed even when the seal between flange 422 and flange 424 is broken. Finally, isolation plug 414 may include a handle 426 for use in manipulating isolation plug 414 into and out of a closed position to alternately seal or open passageway 416. AL 402 may include an access port (FIG. 11) where a technician or operator may reach isolation plug 414 while AL 402 is mated to LRU 404. The access port can include a storable ambidexterous glove (FIG. 11), a mechanical fixture adjacent to a viewing window, and/or a remotely operated manipulator for use in manipulating isolation plug 414 and/or performing a cleaning operation within or from a position inside AL 402.

AL 402 is configured to mate with LRU 406 at a mating region 428 that may include planar and/or interlocking mating surfaces. An isolation plug 434 can be an exemplary embodiment of isolation plug 352 as shown in FIG. 3. In this embodiment, isolation plug 434 mates with a portion of LRU 406 to seal a passageway 436 into LRU 406. In this manner, LRU 406 is environmentally closed and neither air nor other contaminants may enter LRU 406 through the closed passageway 434. LRU 406 may preferably include a flexible clearance control or load path 438 that provides flexible mating between AL 402 and LRU 406 at mating region 428 to form an air-tight seal. Conversely, the seal along mating surface 428 can be broken to separate AL 402 and LRU 406. Flexible path 438 may be configured to move in a telescoping manner towards and away from the corresponding juncture with AL 402. A locking mechanism 440 can include one or more bolts or other fasteners for retain a flange 442 of LRU 406 against a corresponding flange 444 of AL 402. The flanges (422, 424, 442, 444) may be substantially planar in shape or may be non-planar, where each pair of facing flange surfaces has a complementary shape providing proper mating. A non-collinear arrangement of LRU and AL elements may reduce or eliminate the requirement of adjusting the sealing surfaces. Additional embodiments of flexible paths (418, 438) are discussed in reference to FIGS. 14 to 21.

Isolation plug 434 is configured to mate with a portion of flange 442 so that LRU 406 can remain closed even when the seal between flange 442 and flange 444 is broken. Isolation plug 434 may include a handle 446 for use in manipulating isolation plug 434 into and out of a closed position to alternately seal or open passageway 436. A technician or operator may reach and/or manipulate isolation plug 434 while AL 402 is mated to LRU 406 without introducing contaminants to the AL or LRU interior regions. Each of the isolation plugs (414, 434) and/or the corresponding facing members may include a sealing member, such as an o-ring, in order to form an air-tight seal when the corresponding isolation plugs are installed in a closed position against the corresponding flange and/or the respective facing contact member (422, 442). In some applications, a technician may connect, move or attach wires, optical fibers, and/or mechanical linkages within an appropriate AL.

FIG. 5 through FIG. 10 illustrate a sequence of views showing an exemplary removal and replacement of an LRU according to an embodiment of the present invention. In FIG. 5, an old LRU 502 is located between and mated to a first AL 504 and a second AL 506, respectively. AL 504 includes a first isolation plug 508 located at a stored position 510 within first AL 504 interior region 512. Isolation plug 508 is stored in a position away from a juncture 516 between LRU 502 and AL 504 so the passageway between LRU 502 and AL 504 is open. Similarly, AL 506 includes a second isolation plug 518 located at a stored position 520 within second AL 506 interior region 522. Second isolation plug 518 is stored away from juncture 526 between LRU 502 and AL 506 so the passageway between LRU 502 and AL 506 is open. It is understood that isolation plug 508 and isolation plug 518 may each represent a pair of isolation plugs, where each isolation plug in the pair is configured to individually seal either an LRU port or an adjacent AL port. FIG. 5 illustrates a normally opened position providing unimpeded communication between the interior regions of first AL 504, LRU 502, and second AL 506, where all the intermediate isolation plugs are removed, as is expected during normal operation of LRU 502.

FIG. 6 shows both first isolation plug 508 moved to a closed position 602 in the LRU 502 first port blocking the passageway between LRU 502 and AL 504 and second isolation plug 518 moved to a closed position 604 in the LRU 502 second port blocking the passageway between LRU 502 and AL 506. In this manner, LRU 502 is environmentally closed so that neither air nor contaminants may enter. FIG. 7 shows a LRU 502 flexible path 702 in a retracted position to reveal a gap 704 between LRU 502 and AL 504. The one or more bolts or other fasteners retaining the juncture between LRU 502 and AL 504 are removed prior to retracting flexible path 702. Similarly, the one or more bolts or other fasteners retaining the juncture between LRU 502 and AL 506 are removed prior to retracting flexible path 706 to reveal a gap 708 between LRU 502 and AL 506. Once LRU 502 is disconnected from both AL 504 and AL 506, LRU 502 may be removed 710 from a position between AL 504 and AL 506.

FIG. 8 shows a new LRU 802 inserted 804 into a position between AL 504 and AL 506 in the place of old LRU 502. LRU 802 includes a first flexible path 806 in a retracted position to reveal a gap 808 between LRU 802 and AL 504. Similarly, LRU 802 includes a second flexible path 810 in a retracted position to reveal a gap 812 between LRU 802 and AL 504.

FIG. 9 shows first flexible path 806 is extended position so that LRU 802 mates with AL 504 at a juncture 902. LRU 802 includes a first isolation plug 904 located in a closed position 906 so that the passageway between AL 504 and LRU 802 is closed. Similarly, second flexible path 810 is extended so that LRU 802 mates with AL 506 at a juncture 908. LRU 802 includes a second isolation plug 910 located in a closed position 912 so that the passageway between AL 506 and LRU 802 is closed. LRU 802 may be shipped to a field system remote location with isolation plugs (904, 910) installed in a closed position to protect LRU 802 prior to installation. Once the juncture between AL 504 and LRU 802 is sealed, clean air and/or cleaning materials 914 may be circulated through AL 504 in order to purge the interior portion of AL 504 from air and/or contaminants. Similarly, once the juncture between AL 506 and LRU 802 is sealed, clean air and/or cleaning materials 916 may be circulated through AL 506 in order to purge the interior portion of AL 506 from air and/or contaminants. Alternatively, AL 504 and AL 506 may be filled with an inert gas or other material following the cleaning operation.

FIG. 10 shows first isolation plug 904 located at a stored position 510 away from juncture 902 between LRU 802 and AL 504 so the passageway between LRU 802 and AL 504 is open. Similarly, second isolation plug 910 shown located at a stored position 520 away from juncture 908 between LRU 802 and AL 506 so the passageway between LRU 802 and AL 506 is open. In this exemplary replacement process, LRU 802 has replaced LRU 502 as shown in FIG. 5. LRU 802 was not opened until the air and/or other contaminants were removed from the adjacent AL (504, 506). Additionally, clean air and/or cleaning materials 914 may be circulated through the newly connected system 1002 comprising at least AL 504, LRU 802, and AL 506 in order to purge the interior portion of LRU 802 from air and/or contaminants prior to operation of the newly connected system. Alternatively, any or all ALs in the alternately connected network of chambers may be activated to continually purge the interior chamber region and/or to maintain a constant pressure or constant temperature environment at or near an average operating temperature.

Figure 11:
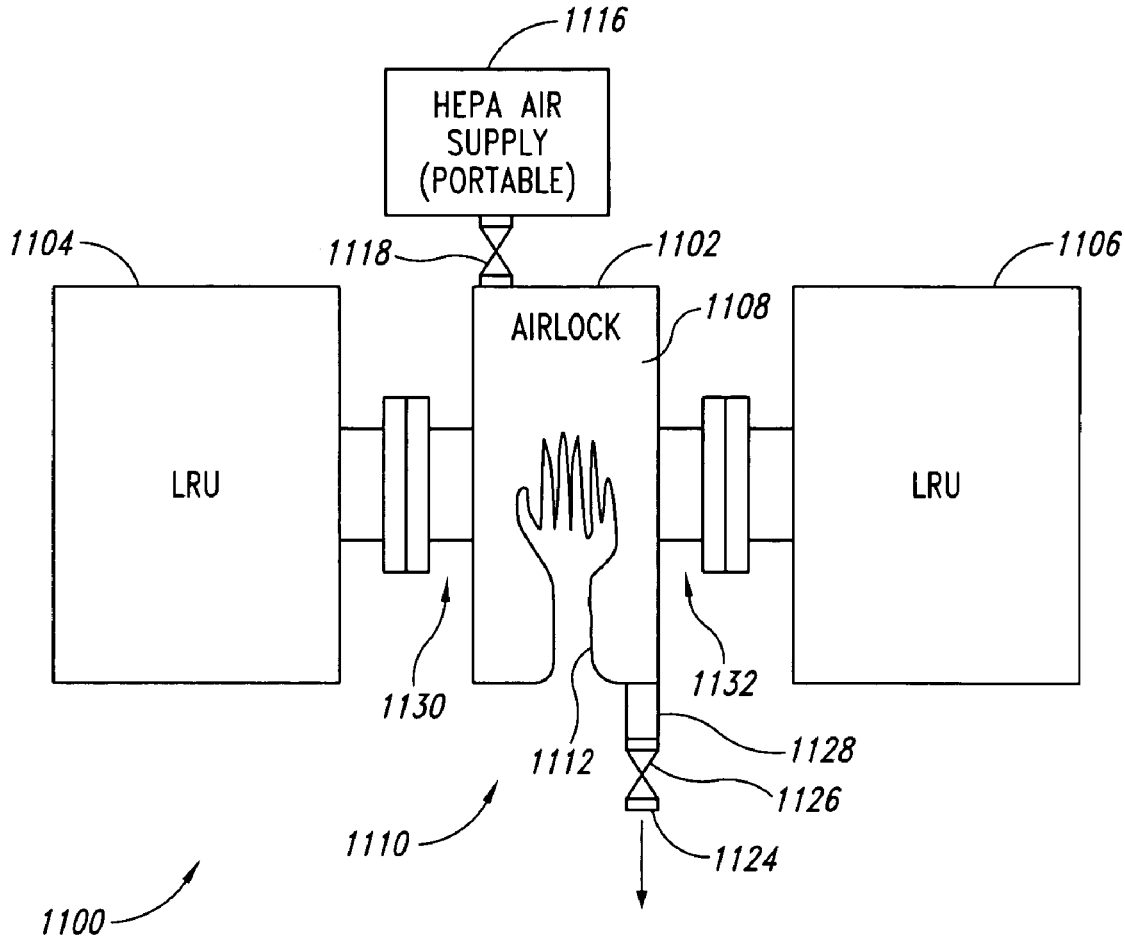
FIG. 11 shows a top plan view of an exemplary portion of a field system including an AL with an access port and connected to a purge gas supply according to an embodiment of the present invention.

FIG. 11 shows a top plan view of an exemplary portion of a field system 1100 including an AL 1102 with an access port and connected to a purge gas supply according to an embodiment of the present invention. AL 1102 may be connected to an adjacent first LRU 1104 and a second LRU 1106. AL 1102 may include an access port 1110 including an ambidextrous glove 1112 that is configured to allow a user or operator to insert either hand into the glove 1112 to reach into AL 1102 to perform operations such as inserting or removing isolation plugs, opening or closing a purge valve, and/or cleaning an interior region of AL 1102. A base portion of glove 1112 may form a closed portion of AL 1102 so that air and/or contaminants may not pass through or around glove 1112 and enter the AL 1102 interior region.

A purge gas supply source 1116, and/or high-pressure air supply, may provide a filling or cleansing gas such as clean air to a one-way valve 1118 connected to AL 1102 for introduction into an AL 1102 interior region 1108. In this manner, source 1116 can provide an inflow of gases into AL 1102. As an exhaust for at least a portion of the inflow of gases and/or contaminants, an exhaust vent 1124 may be connected to a one-way valve 1126 that receives a supply of exhaust gases through a particle counter 1128 that is configured to detect the particle concentration and/or other properties of the exhaust gases. Particle counter 1128 may determine when a contamination level, such as one measured in particles per cubic meter, is within acceptable levels for operation of the system 1100. Alternatively, particle counter 1128 may continuously monitor exhaust gases to during normal operation of field system 1100. AL 1102 may also include another selectively accessible port to allow the introduction of cleaning materials, such as lint-free cleaning wipes, prior to activating purging gas supply 1116. Alternatively, cleaning materials may be inserted through either a first AL access port 1130 or a second AL access port 1132 prior to mating with an adjacent LRU. A limited supply of cleaning materials, such as lint-free wipes, may be stored in a closable compartment (not shown) within AL 1102. Auxiliary controlled access may be provided for supply and removal of these cleaning materials to the ALs.

Figure 12:
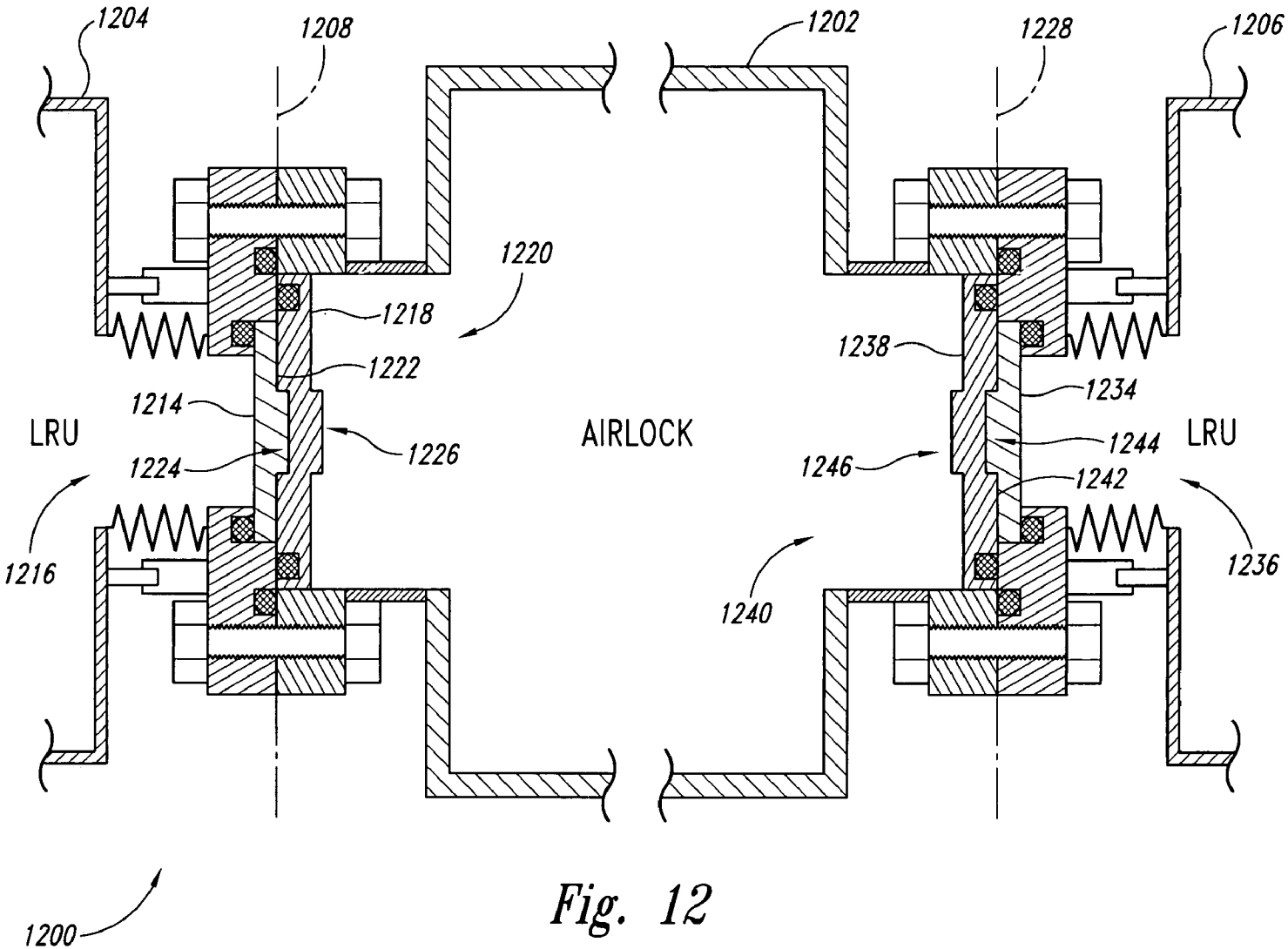
FIG. 12 shows a top plan view of an exemplary portion of a field system including an AL and adjacent LRUs according to an embodiment of the present invention.

FIG. 12 shows a top plan view of an exemplary portion of a field system 1200 including an AL 1202 and adjacent LRUs (1204, 1206) according to an embodiment of the present invention. AL 1202 is configured to mate with LRU 1204 along a mating surface 1208 that may include planar and/or interlocking mating surfaces. A first isolation plug 1214 is an exemplary embodiment of isolation plug 308 as shown in reference to FIG. 3. In this embodiment, isolation plug 1214 mates with a portion of LRU 1204 to seal a passageway 1216 into LRU 1204 so that neither air nor other contaminants may enter LRU 1204 through the closed passageway 1216. A second isolation plug 1218 is configured to seal a passageway 1220 into AL 1202 so that neither air nor other contaminants may enter AL 1202 through the closed passageway 1220. Thus, first isolation plug 1214 can seal passageway 1216 and second isolation plug 1218 can seal passageway 1220 when AL 1202 and LRU 1204 are connected or when they are separated. For example, first isolation plug 1214 and second isolation plug 1218 may independently seal LRU 1204 and AL 1202, respectively, prior to connecting in an exemplary process described in reference to FIGS. 5-10. Once AL 1202 and LRU 1204 are connected, a user may remove either or both isolation plugs (1214, 1218) as described in reference to FIG. 11.

AL 1202 is configured to mate with LRU 1206 along a mating surface 1228 that may include planar and/or interlocking mating surfaces. A third isolation plug 1234 mates with a portion of LRU 1206 to seal a passageway 1236 into LRU 1206 so that neither air nor other contaminants may enter LRU 1206 through the closed passageway 1236. A fourth isolation plug 1238 is configured to seal a passageway 1240 into AL 1202 so that neither air nor other contaminants may enter AL 1202 through closed passageway 1240. Thus, third isolation plug 1234 can seal passageway 1236 and fourth isolation plug 1238 can seal passageway 1240 when AL 1202 and LRU 1206 are connected or when they are separated. For example, third isolation plug 1234 and second isolation plug 1238 may independently seal LRU 1206 and AL 1202, respectively, prior to connecting in an exemplary process described in reference to FIGS. 5-10. Once AL 1202 and LRU 1204 are connected, a user may remove either or both isolation plugs (1234, 1238).

In one embodiment, first isolation plug 1214 and second isolation plug 1218 are configured to mate closely together so that the volume of a space 1222 between the isolation plugs (1214, 1218) is very small to minimize or prevent the accumulation of air or other contaminants in space 1222, and isolation plugs (1214, 1218) may be suitably shaped to inhibit the flow of contaminants into space 1222. First isolation plug 1214 may include a protruding portion 1224 with a shape that is configured to follow an interior shape of a corresponding portion of second isolation plug 1218 so that the isolation plugs mate together to provide interlocking structural support. Similarly, second isolation plug 1218 may include a protruding portion 1226.

A third isolation plug 1234 and a fourth isolation plug 1236 are also configured to mate closely so that the volume of a space 1242 between the isolation plugs (1234, 1236) is very small and may be suitably shaped to inhibit the flow of contaminants into space 1242. Third isolation plug 1234 may include a protruding portion 1244 with a shape that is configured to follow an interior shape of a corresponding portion of fourth isolation plug 1238 so that the isolation plugs mate together to provide interlocking structural support. Similarly, fourth isolation plug 1238 may include a protruding portion 1246. Protruding portions (1224, 1226, 1244, 1246) may be used as handles or contact points for manipulating the respective isolation plug. Each of the isolation plugs (1214, 1218, 1234, 1238) or their respective facing contact members may include a sealing member, such as an o-ring, in order to form an air-tight seal when the corresponding isolation plug is installed in a closed position.

Figure 13:
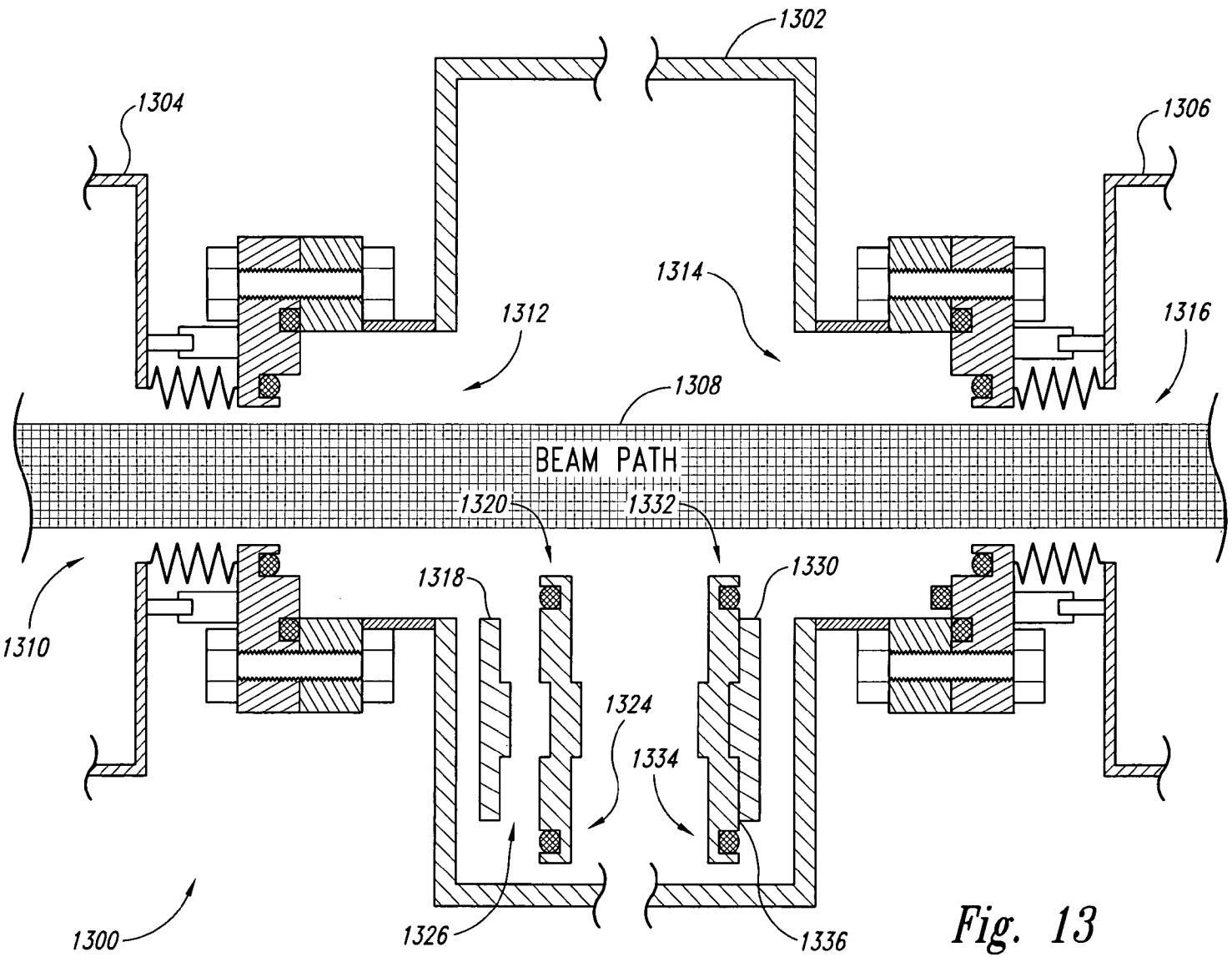
FIG. 13 shows a top plan view of an exemplary portion of a field optical system 1300 including an airlock (AL) 1302 and adjacent LRUs (1304, 1306) according to an embodiment of the present invention.

FIG. 13 shows a top plan view of an exemplary portion of a field optical system 1300 including an airlock (AL) 1302 and adjacent LRUs (1304, 1306) according to an embodiment of the present invention. FIG. 13 shows a beam path 1308 passing through a central region of AL 1302, LRU 1304, and LRU 1306 defined by passageways including a first LRU passageway 1310, a first AL passageway 1312, a second AL passageway 1314, and a second LRU passageway 1316 where each passageway (1310, 1312, 1314, 1316) is open. A first isolation plug 1318 and a second isolation plug 1320 are configured to close passageway 1310 and passageway 1312, respectively when installed in a closed position, yet they can be stored in a first storage position 1324 in a location away from beam path 1308.

Optionally, first isolation plug 1318 and second isolation plug 1320 may be separated from each other by a gap 1326 so that all surfaces of both isolation plugs (1318, 1320) are accessible within AL 1302. In this manner, if a purging gas is introduced within an interior region of AL 1302 then the purging gas may be able to circulate across all surfaces of both isolation plugs (1318, 1320). A third isolation plug 1330 and a fourth isolation plug 1332 are configured to close passageway 1316 and passageway 1314, respectively when installed in a closed position, yet they can be stored in a second storage position 1334 in a location away from beam path 1308. Third isolation plug 1330 and fourth isolation plug 1332 may have interlocking mating surfaces in contact with each other so that the isolation plugs mate together, the volume of a space 1336 between third isolation plug 1330 and fourth isolation plug 1332 is very small, and so that not all surfaces of both isolation plugs (1330, 1332) are accessible within AL 1302. In this manner, if a purging gas is introduced within an interior region of AL 1302 then the purging gas may not be able to circulate across all surfaces of both isolation plugs (1330, 1332). Alternatively, third isolation plug 1330 and fourth isolation plug 1332 may be stored together with first isolation plug 1318 and/or second isolation plug 1320 in or near storage location 1324, or in some other location within AL 1302 so as not to interfere with the communication of beam bath 1308 between adjacent chambers.

Figure 15:
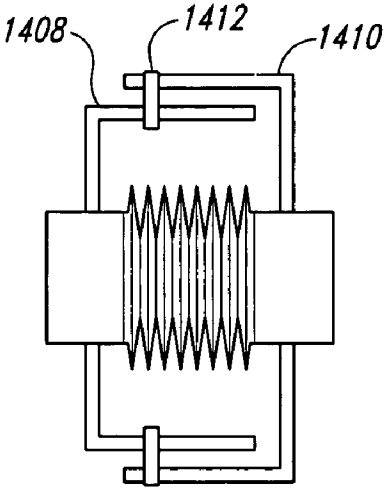
FIGS. 14-15 show a side plan view of a bellows apparatus in an expanded and compressed position according to an embodiment of the present invention.
Figure 14:
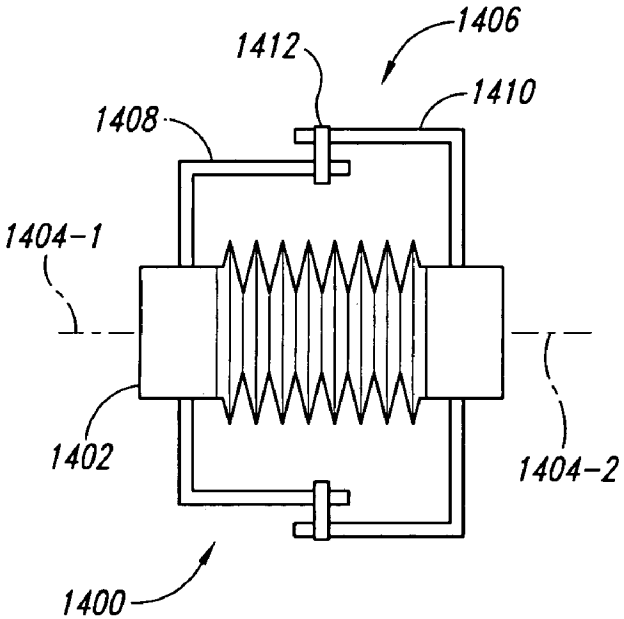

FIG. 14 shows a side plan view of a bellows apparatus 1400 in an expanded position according to an embodiment of the present invention. Bellows apparatus 1400 may be included in an exemplary LRU flexible clearance control or load path 418 such as shown in FIG. 4. Bellows apparatus 1400 may include a cylindrical bellows member 1402 configured to pass a light beam, wires, and/or optical cables along a beam path 1404 where member 1402 can extend and/or retract along beam path 1404. Bellows apparatus 1400 includes a frame 1406 configured to support bellows member 1402. Frame 1406 includes a first vertical yoke 1408 attached to a bellows member 1402 first end, a second vertical yoke 1410 attached to a bellows member 1402 second end, and a reposition latch mechanism 1412 for fixing the relative positions of the yokes (1408, 1410) and that can be adjusted to match the compression or expansion of bellows member 1402. FIG. 15 shows a side plan view of bellow apparatus 1400 in a compressed position according to an embodiment of the present invention. In this case, yoke 1408 is moved towards yoke 1410 and latch mechanism 1412 is configured to fix the compressed position of yokes (1408, 1410).

Figure 16:
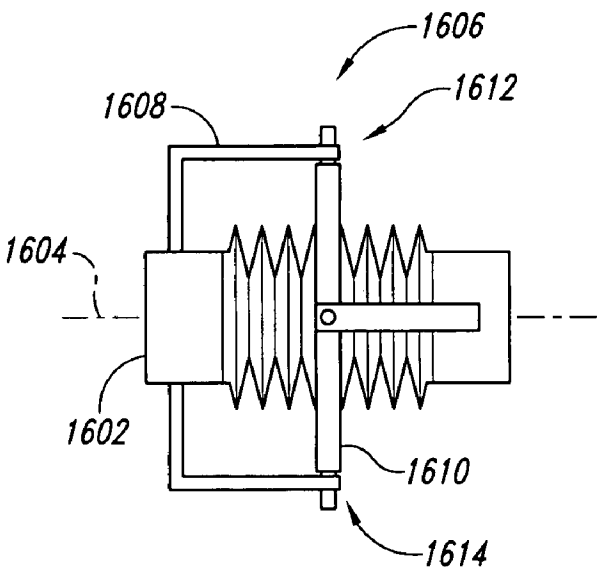
FIG. 16 shows a side plan view of a bellows apparatus used for angulation, or angular articulation, that can transmit relatively large loads without adjustment according to an embodiment of the present invention.

FIG. 16 shows a side plan view of a bellows apparatus 1600 used for angulation, or angular articulation, that can transmit relatively large loads without adjustment according to an embodiment of the present invention. Bellows apparatus 1600 may be used to connect a portion of an LRU to an adjacent AL. Bellows apparatus 1600 may include a cylindrical bellows member 1602 configured to pass a light beam along a beam path 1604 and includes a frame 1606 configured to support bellows member 1602. Frame 1606 includes a vertical yoke 1608 attached near a bellows member 1602 first end, a horizontal yoke 1610 attached near a bellows member 1602 second end, and a pair of pivot pins (1612, 1614) that provide vertical yoke 1608 and horizontal yoke 1610 to pivot where the ends of member 1602 can be articulated to rotationally deflect a portion of member 1602 away from alignment with beam path 1604. In some applications, this angulation may be used to align opposing flange surfaces in order to mate corresponding portions of an LRU with an adjacent AL.

Figure 17:
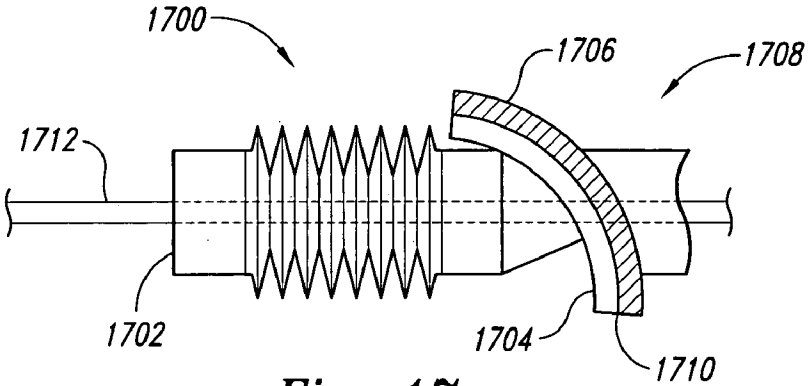
FIGS. 17-19 show a side plan view of a bellows apparatus including a bellows member and a spherical flange, and/or members thereof, according to an embodiment of the present invention.

FIG. 17 shows a side plan view of a bellows apparatus 1700 including a bellows member 1702 and a spherical flange 1704 according to an embodiment of the present invention. Bellows apparatus 1700 may be included in an LRU flexible clearance control or load path 418 such as shown in FIG. 4. Spherical flange 1704 has a curved surface that is adapted to form an air-tight seal with a correspondingly curved flange 1706 on an adjacent apparatus 1708 such as an LRU or AL unit. The juncture of flange 1704 and flange 1706 forms a sealing surface 1710. In an optical system application, a beam path 1712 defines a central region of bellows apparatus 1700 along the longitudinal axis where a light beam may travel. FIG. 17 shows a desired mating of flange 1704 to flange 1706 that both forms an air-tight seal as well as permits the passage of a light beam along beam path 1712.

Figure 19:
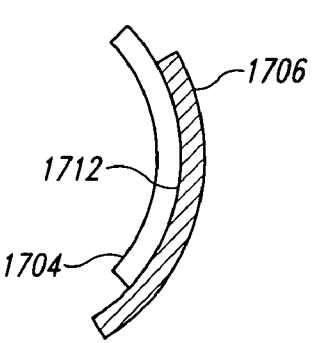
Figure 18:
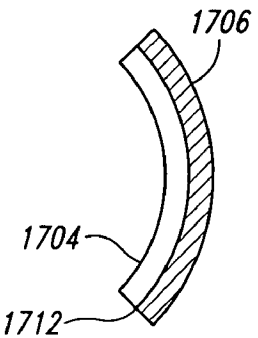

FIGS. 18 and 19 show spherical flanges 1704 and 1706 may be rotated slightly, and/or slide relative to each other, without affecting the mating of sealing surfaces.

Figure 20:
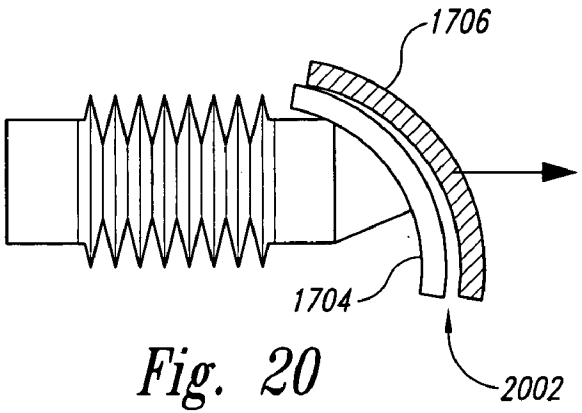
FIG. 20 shows an undesirable mating of a first flange to a second flange where a gap exists due to a mismatch or horizontal dimensional error, in accordance with an embodiment of the present invention.

FIG. 20 shows an undesirable mating of a first flange 1704 to a second flange 1706 where a gap 2002 exists due to a mismatch or horizontal dimensional error. In this case, gap 2002 may permit the introduction of air and/or other contaminants to an interior region of bellows apparatus 1700 and/or an interconnected system. Alternatively, gap 2002 may permit a pressurized gas to escape from within a closed system comprising a plurality of interconnected AL and LRU modules.

Figure 21:
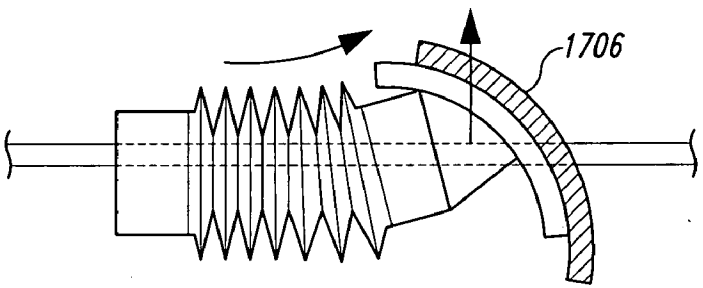
FIG. 21 shows the establishment of a seal between the flanges due to an angulation, or movement in an angular manner, of a portion of the bellows apparatus 1700 (2-axis) causing relative movement between the flanges to close a gap.

FIG. 21 shows the establishment of a seal between the flanges (1704, 1706) due to an angulation, or movement in an angular manner, of a portion of the bellows apparatus 1700 (2-axis) causing movement of flange 1704 toward flange 1706 to close a gap. This motion of the bellows can be constrained by yokes, as shown in FIG. 16, to allow loads (e.g. vacuum pressure) to be transmitted between LRUs and ALs with precise adjustments of dimensions.

Figure 22:
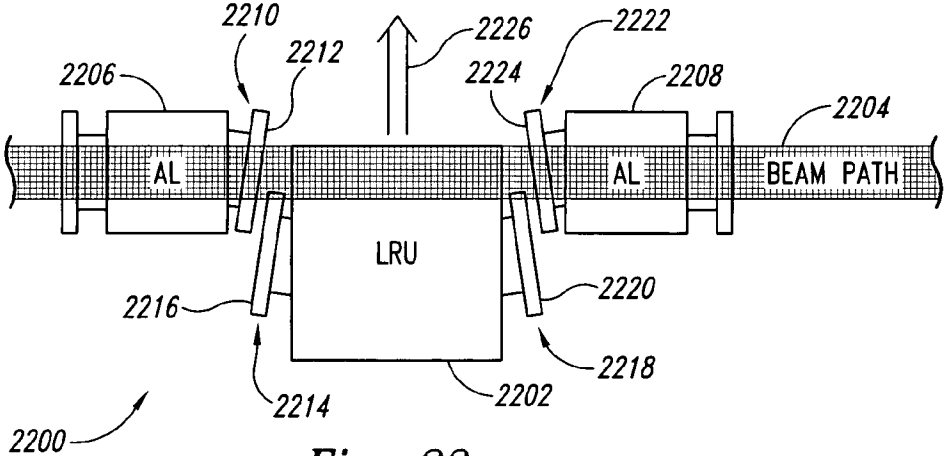
FIG. 22 shows a top plan view of an exemplary portion of a field system including a Line Replaceable Unit (LRU) located in a first position that is offset from a beam path passing through a first AL and a second AL according to an embodiment of the present invention.

FIG. 22 shows a top plan view of an exemplary portion of a field system 2200 including a Line Replaceable Unit (LRU) 2202 located in a first position that is offset from a beam path 2204 passing through a first AL 2206 and a second AL 2208 according to an embodiment of the present invention. First AL 2206 includes an angled flange 2210 with a first surface 2212 while LRU 2202 includes a corresponding second angled flange 2214 with a second surface 2216. Similarly, LRU 2202 includes a third angled flange 2218 with a third surface 2220 while AL 2208 includes a corresponding fourth angled flange 2222 with a fourth angled surface 2224. LRU 2202 may be moved in an insertion direction 2226 as shown in FIG. 22 that causes surface 2212 to mate with surface 2216 and surface 2220 to mate with surface 2224 so that LRU 2202 may be properly positioned between AL 2206 and AL 2208 and astride beam path 2204.

Figure 23:
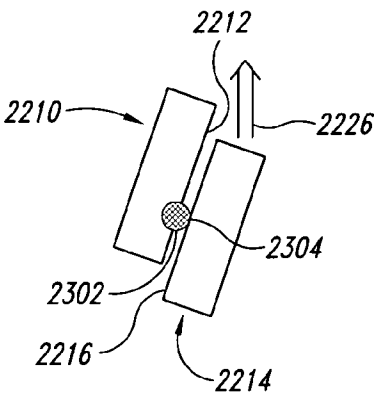
FIG. 23 shows a close-up view where a portion of a second flange surface contacts an exemplary portion of an uncompressed sealing member at an initial contact point as second flange is moved in an insertion direction towards a first flange surface according to an embodiment of the present invention.

FIG. 23 shows a close-up view where a portion of a second flange surface 2216 contacts an exemplary portion of an uncompressed sealing member 2302 at an initial contact point 2304 as second flange 2214 is moved in an insertion direction 2226 towards a first flange surface 2210 according to an embodiment of the present invention. Motion in insertion direction 2226 may scuff or causes abrasion with sealing member 2302 forming an air-tight seal. Sealing member 2302 can be an o-ring, a gasket, or other gas sealing member to provide a seal between LRU 2202 and AL 2204.

Figure 24:
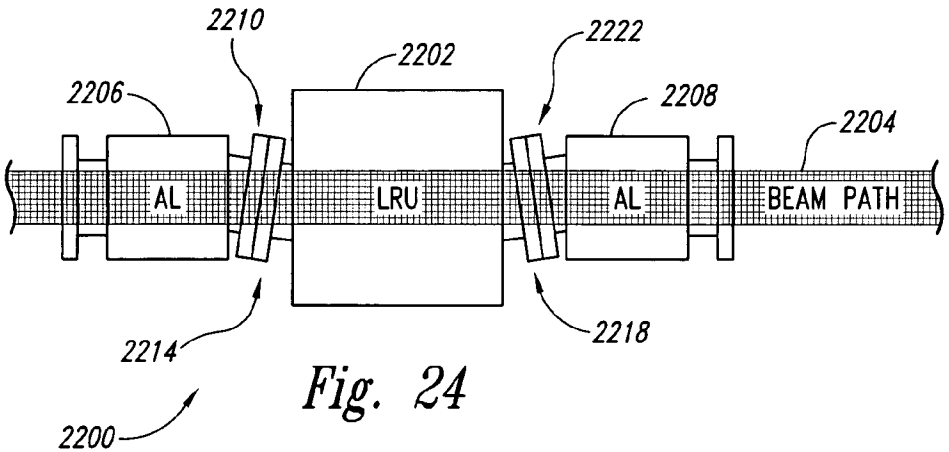
FIG. 24 shows a top plan view of an exemplary portion of a field system where an LRU is located in a second position that is aligned with a beam path passing through a first AL and a second AL according to an embodiment of the present invention.

FIG. 24 shows a top plan view of an exemplary portion of a field system 2200 where LRU 2202 is located in a second position that is aligned with beam path 2204 passing through a first AL 2206 and a second AL 2208 according to an embodiment of the present invention. In this manner, an error in longitudinal spacing along beam path 2204 may be compensated slightly by motion in the insertion direction.

Figure 25:
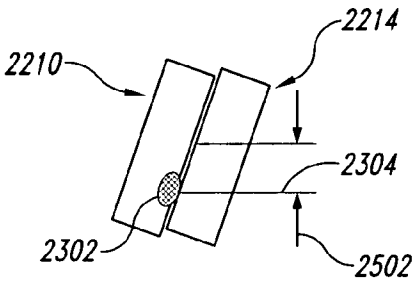
FIG. 25 shows a close-up view where a first flange is mated to a second flange and a sealing member is in a compressed state according to an embodiment of the present invention.

FIG. 25 shows a close-up view where first flange 2210 is mated to second flange 2214 and sealing member 2302 is in a compressed state according to an embodiment of the present invention. An insertion distance 2502 is the distance LRU 2202 travels in insertion direction 2226 after second surface 2216 makes contact with uncompressed sealing member 2302.

Figure 26:
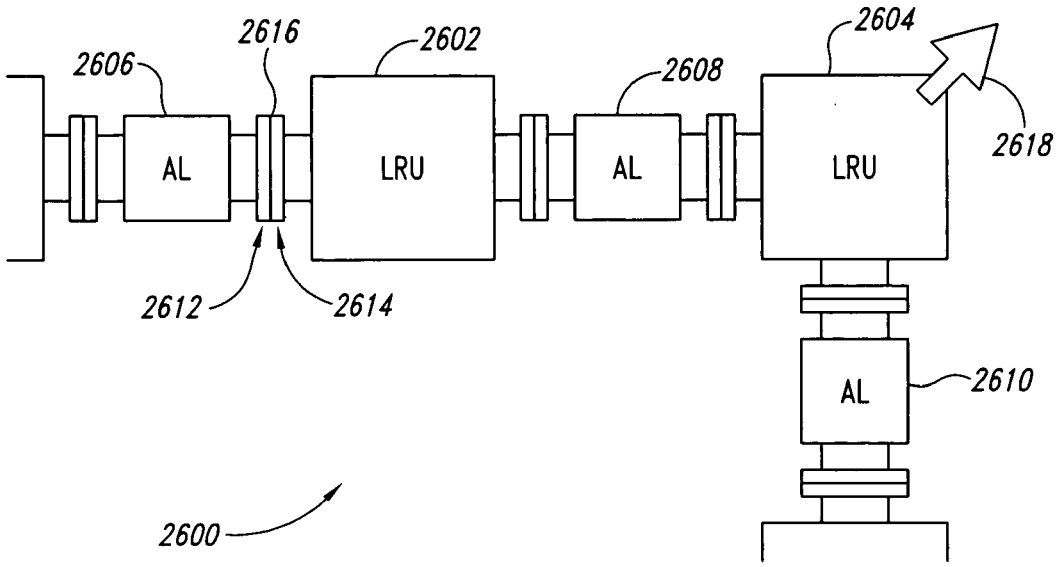
FIG. 26 shows a top plan view of an exemplary portion of a field system with a plurality of components including a plurality of LRUs interconnected by a plurality of ALs in an alternating manner to form a closed environmental system providing a closed optical path according to an embodiment of the present invention.

FIG. 26 shows a top plan view of an exemplary portion of a field system 2600 with a plurality of components including a plurality of LRUs (2602, 2604) interconnected by a plurality of ALs (2606, 2608, 2610) in an alternating manner to form a closed environmental system providing a closed optical path according to an embodiment of the present invention. Alternatively, a plurality of LRUs may be connected in a serial manner without an intervening AL.

AL 2606 includes a flange 2612 while LRU 2602 includes a flange 2614 that can mate together to form a juncture 2616 connecting AL 2606 and LRU 2602. Similarly, interconnections between other adjacent elements can be completed to form the closed system of alternating elements. In this manner, the connection of AL 2606, LRU 2602, AL 2608, and LRU 2604 comprise a linear connection of alternating elements. Similarly, a light beam may pass through LRU 2604 as a bent-pipe component of field system 2600 where the light changes direction such as by striking a mirrored surface. A linear arrangement may trap adjacent components while the bent-pipe arrangement may simplify component removal and replacement.

In some applications, the LRUs may be configured so that the connections to the ALs are not located in-line with each other so that LRUs may be removed without physically interfering with the ALs. Where the LRUs and ALs must be located in-line, the interconnecting flanges may be designed to facilitate hardware removal while still providing a load path between the ALs. For example, the flanges at the opposed ends of the LRUs may be tilted at reciprocal angles such that the LRU and its flanges may "slip" between the air locks that interface with it. Depending on the application, the interconnecting flanges may be made from off-axis segments of a sphere and fitted with one or more bellows and yokes to allow self-aligning and the take-up of any dimensional differences or gaps in spacing between an LRU and an adjacent AL.

Some embodiments may be related to a design and/or configuration of a system including an airlock which may be connected to one or more modular optical components, enabling an environmentally controlled system with modular components to be operated and maintained under field condition without extensive preparation and training, while meeting military and/or other specifications including one or more of the following:

(1) Enabling contamination free removal and replacement of modular optical components;
(2) Integration of a modular optical system with minimal impact on packaging;
(3) Passing one or more optical beams through an airlock without negatively affecting the beam;
(4) Reducing or eliminating the need for external contamination control provisions;
(5) Facilitating alignment of optical packages contained in the modular optical components within the optical system;
(6) Simplifying packaging, installation and/or removal of optical components by reducing or eliminating the need for expansion joints used to relieve stresses induced by differential thermal expansion or contraction;
(7) Providing environmental control;
(8) Providing position control;
(9) Maintaining internal alignment of each module for remotely aligning the entire system;
(10) Providing a Built-in-Test/Built-in-Test-Equipment (BIT/BITE) capability; and
(11) Satisfying a Mean-Time-to-Repair (MTTR) threshold.

Some embodiments of the present invention can enable the removal and replacement of optical Line Replaceable Units (LRUs) in a field environment without contaminating the optics and without requiring that the environment around the optical system be maintained in a clean condition by utilizing HEPA filtered air flowing in a clean room environment and/or personnel performing this removal and replacement wearing protective non-contaminating clothing such as gowns, booties and hair coverings. One or more embodiments of the present invention provide at least one of the following benefits:

(1) Field Maintainability and Operability with a minimal logistics tail or supply and maintenance chain: The optics and/or electro-optics may be grouped into one or more Line Replaceable Units (LRUs) that can be removed and replaced in the field, including handling by technicians wearing protective gear as required.
(2) Operating environmental Control: The optical elements are contained within multiple LRUs alternating with ALs that provide environmental control. Special equipment (e.g. fixturing) may be provided to assure cleanliness as described in the following section.
(3) Contamination Control: Contamination control is obtained through isolation of LRUs from ALs and decontamination of ALs as required. This is accomplished through fittings and fixtures that permit localized clean conditions to be established with minimal effort, and by providing fixtures in these clean areas through which the modules may be removed or replaced. An exemplary process of replacing an LRU is depicted in reference to FIG. 5 through FIG. 10. In this case it is not necessary to obtain clean conditions or fugitive dust control outside of the optical system. In particular, it is not necessary to tent and/or otherwise clean the area around the optical bench, LRUs and ALs. Further, the ALs and/or LRUs may include internal plugs or caps to provide positive control over contamination within the modules prior to assembly and after replacement. It is unnecessary to provide protective over-wraps on the LRUs other than to assure that sealing surfaces do not become damaged in shipping and handling.
(4) Position Stability: The optical tables within the LRUs are attached to a common optical bench or benches through kinematic mounts that assure assembly without distortion that could affect the relative alignment of the LRU components, such as finely positioned optics. Optical elements may be mounted to optical tables that can be attached to the kinematic mounts, allowing positioning of the optical elements on the optical tables using appropriate tools prior to shipping and then reproducing that alignment in under field conditions using the kinematic mounts. Vibration and position isolation may be provided around the attachments between the LRUs and ALs and between the optical tables within the LRU and the LRU structure. The ALs may provide mechanical support to the vacuum or environmental containers comprising the LRUs.
(5) Position Controllability: The modules are constructed such that any optical elements contained within an LRU module may be aligned as an assembly or subassembly with respect to the entire optical system remotely and without breaching of the environmental control when the modules are installed correctly using the kinetic mounts and fastening hardware.
(6) Thermal Control: Optical systems are inherently thermally sensitive since expansion may affect optical alignment, figure and curvature. Provisions are needed to stabilize the temperature to tight tolerances while operating in a platform that is poorly controlled compared to conditions in conventional optical systems. This entails providing passive thermal management that can both adsorb and release heat, thereby allowing the optical modules to maintain a tightly controlled temperature at or near the average temperature for the environment in the weapon platform.
(7) Health Status: The modules may provide the capability of diagnosing the health and/or status of any module using BIT/BITE capabilities resident to the module or utilizing capabilities within one or more additional modules. The health status may be displayed locally or through a central control system, and the display is simplified such as to provide a trained technician clearly understandable information, e.g., "GO/NO GO" status lights based on granularity or coarse operational nature of the modules.

(8) Facile Removal and Replacement: The modules are fitted with handles, fixtures, and other features to facilitate the safe handling, installation and removal, and checkout of the modules. Where beneficial these features may be accompanied by features on other items, including the stability control hardware, to assure that the modules may be positioned without damage. The connecting points of the modules may contain compressive elements (e.g., bellows) which provide an effective "zero-clearance" installation capability to facilitate removal and replacement operations in conjunction with the airlock(s). The airlocks may be fitted with spherical flanges mating with spherical flanges on the interfacing LRU modules that, along with the packaging arrangement, mitigate the impact of differential thermal expansion. The modules are designed and configured so that each module may be removed and/or replaced independently from any other modules.

To maintain cleanliness, LRUs and ALs may be delivered to the optical system located in the field environment in a clean condition and with the isolation plugs installed. The plug for the LRU to be removed may be reinstalled from the AL, thus isolating the LRU from the AL. The AL may have plugs and/or dust covers installed to reduce the level of contamination in the AL. After this, the LRU flanges may be unbolted and compressed to allow removal. The new LRU is then brought into position in the compressed condition, and then released and attached to the AL, after removal of dust-covers from the AL as necessary. At this point the contents of the LRU are clean and protected by the plugs, but the AL may be somewhat contaminated. The AL may then be returned to a clean or operational condition by blowing filtered air through the AL and/or supplying a quantity of a purge gas. Due to the small size and limited exposure, this process of returning to a clean condition will be quite brief. All of these operations can be performed without any special contamination control outside of the ALs, and in particular it is not necessary to tent or otherwise clean the area around the optical bench, LRUs and ALs. In this case, it is unnecessary to provide protective over-wraps on the LRUs other than to assure that sealing surfaces do not become damaged in storage, shipping and handling.

Laser Weapon Systems

Figure 27:
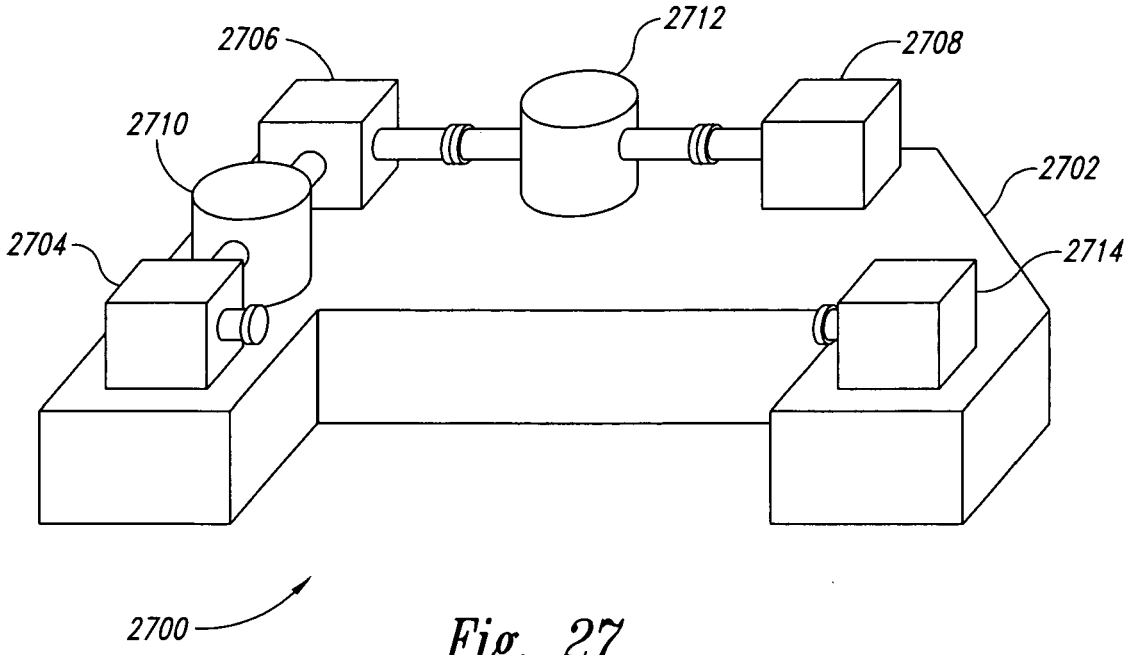
FIG. 27 shows a Laser Weapon System, such as a high-power precision optical system, that may include a frame configured to support a plurality of LRUs interconnected by a plurality of ALs according to an embodiment of the present invention.

In reference to FIG. 27, one or more embodiments of the present invention are drawn to applications including a tactical High Energy Laser (HEL) weapon system, and deployment of high-energy lasers such as used in laser welding and machining. FIG. 27 shows a Laser Weapon System 2700, such as a high-power precision optical system, that may include a frame 2702 configured to support a plurality of LRUs (2704, 2706, 2708) interconnected by a plurality of ALs (2710, 2712) according to an embodiment of the present invention. LWS 2700 may also include an isolated LRU 2714 that, while not interconnected through an AL, may be removably attached to a kinetic mount. LWS 2700 may be integrated onto a mobile combat platform such as an aircraft, a ship, a wheeled, and/or a tracked vehicle such as a tank. Alternatively, LWS 2700 may be integrated into a land-based weapon utilizing one or more mirrors to reflect the laser output. Embodiments of the present invention comprise a design and configuration of a weapon system application that is modular, can be operated and maintained without extensive and time consuming preparations and training, while meeting military needs for a fielded weapon.

An application of one or more embodiments of the present invention to a tactical HEL or other weapon system may include one or more of the following specifications:

(1) Providing environmental control for the optics;

(2) Providing for position control of the optics after installation and removal and replacement;

(3) Maintaining internal alignment of the optics that may be aligned remotely along with the entire optical system;

(4) Providing a Built-in-Test/Built-in-Test-Equipment (BIT/BITE) capability;

(5) Satisfying a Mean-Time-to-Repair (MTTR) threshold; and (6) Integrating one or more modules onto a HEL aircraft platform for use in a combat environment. The disclosed modules may provide at least a portion of a laser resonator and beam control capability in conjunction with a beam director and turret, all of which may be mounted to and/or in an aircraft, for example, that may act as a HEL platform;

(7) Providing thermal control for the module components (e.g. optical system);

(8) Incorporation of field replaceable optics which can be promptly maintained by military technicians without requiring extensive training; and (9) Providing an airlock that is used both to interface between adjacent modules and to provide access to one or more modular optical components.

Application of one or more embodiments of the present invention to the development, deployment, and/or operation of a tactical HEL or other weapon system may provide at least one of the following benefits:

(1) Field Maintainability and Operability with a minimal logistics tail and/or burden. The optics and/or electro-optics may be grouped into Line Replaceable Units (LRUs) that can be removed and replaced in the field, including maintenance by technicians wearing protective gear as required. The system may have a greatly reduced parts count at the fielded level, since optics are replaced as functional units rather than individual components.

(2) Minimal Special Tooling: The optical elements may be contained within multiple LRUs, each of which can be replaced without the need for special fixturing, such as clean rooms and tenting, and without the need for complex alignment equipment. Since the maintenance operation typically deals with relatively small objects, there is no the need for special power equipment for the handling of large, monolithic systems.

(3) Minimal Special Training: Along with the elimination of special tooling and the handling of precision optical components, there is a large reduction of the amount of training needed to evaluate the operational health and/or status of the optical system and/or when repairs may be needed. The LRUs may include internal sensors for reporting health, status, and/or other parameters. Hence the LRUs may be treated as "generic" black boxes.

(4) Compatibility with Existing Military Specialties: The optical system requires only routine training in the maintenance operations since at no time will support personnel come into contact with optical elements or be called on to perform complex optical processes such as alignment. Widely available military specialties in avionics and mechanical systems provide an appropriate background for the support personnel.

(5) Robustness to Operating Environment: The optical system is designed to eliminate the need for special environmental control, including satisfaction of thermal requirements and/or cleanliness, and therefore places a much lower burden on the platform.

(6) Component Interchangeability: The system is designed for component interchangeability by setting key design features (e.g., alignment internal and external to the LRUs) during the manufacturing process. This assures that the process of production of components (LRUs) produces identical and interchangeable parts.

(7) Minimal Time to Repair: The modules are fitted with handles, fixtures, and other features to facilitate the safe handling, installation and removal, and checkout of the modules. In general, the LRUs provide a simple and clear process for removal of a failed module and replacement with a new module. The modules also provide BIT/BITE capability to facilitate the location and isolation of faults. The LRU-based approach allows for the removal and replacement of modules without requiring the removal of other LRUs in the system, and may not affect the operation of other LRUs at all in some cases.

(8) Smaller, lighter components: The modular design approach keeps the size of components (LRUs) that need to be handled relatively small, and the components are generally lightweight and easily handled. This may be particularly so in the case of vacuum optical systems, where the small size of the LRUs allows thin, light structures to be used for the enclosures.

(9) Lower System Life Cycle Cost (LCC): Due to the changes in design approach the overall life cycle cost (LCC) for the system can be greatly reduced, due principally to the reduced maintenance footprint in the field, reduced logistical burden, and reduced manpower requirement.

Embodiments described above illustrate but do not limit the invention. It should also be understood that numerous modifications and variations are possible in accordance with the principles of the present invention. Accordingly, the scope of the invention is defined only by the following claims.

We claim:

1. A manufacturing system, comprising:

a factory system including a first mount configured to receive, support, and precisely locate a removable line replaceable unit (LRU) including one or more components at a first factory LRU station within the factory system, the received LRU components being capable of adjustment to configure proper operation of the received LRU within the factory system; and a field system corresponding to the factory system, the field system having a second mount configured to receive, support, and precisely locate an LRU removed from the factory system at a first field LRU station corresponding to the first factory LRU station, the removed and received LRU being configured for proper operation within the field system without adjustment of the one or more LRU components;

wherein the field system received LRU includes an LRU environmental enclosure surrounding an LRU interior region, the LRU environmental enclosure having a first port and a second port, with the field system further comprising:

a first air lock (AL) disposed adjacent to the first field LRU station, the first AL having an environmental enclosure surrounding a first AL interior region, the first AL enclosure having a first port and a second port, the first AL second port being configured to releasably connect to the field system received LRU first port to form a first air-tight conduit; and a second AL disposed adjacent to the first field LRU station, the second AL having an environmental enclosure surrounding a second AL interior region, the second AL enclosure having a first port and a second port, the second AL first port being configured to releasably connect to the field system received LRU second port to form a second air-tight conduit.

2. The system of claim 1, wherein each mount is a kinematic mount providing at least one of angular, translational, and elevational positioning for the supported LRU.

3. The system of claim 2, wherein each kinematic mount includes at least one of a cone, a groove, and a planar surface.

4. The system of claim 2, wherein each kinematic mount includes at least one bolt configured to pass through a center of one of a registration surface and a mating surface to eliminate torque-induced distortion.

5. The system of claim 1, further comprising at least one of:

a first isolation plug configured to selectively seal the LRU first port;

a second isolation plug configured to selectively seal the LRU second port;

a third isolation plug configured to selectively seal the first AL second port; and a fourth isolation plug configured to selectively seal the second AL first port, wherein one of the first isolation plug and the third isolation plug are configured to seal the first air-tight conduit, and wherein one of the second isolation plug and the fourth isolation plug are configured to seal the second air-tight conduit.

6. The system of claim 5, wherein each AL further comprises:

an access port configured to permit a user to access an interior region of the AL.

7. The system of claim 6, wherein the access port further comprises:

at least one of a glove and a remote manipulator configured to manipulate at least one of the first isolation plug, the second isolation plug, the third isolation plug, and the fourth isolation plug.

8. The system of claim 1, further comprising:

a purge gas source operably connected to at least one of the first AL and the second AL, the purge gas source being configured to provide a quantity of purge gas under pressure to purge at least one of the first AL and the second AL interior regions of contaminants.

9. The system of claim 1, wherein the manufacturing system further comprises a line replaceable unit (LRU) configured to support one or more LRU components, the LRU being configured to mate with one of the first mount and the second mount.

10. The system of claim 9, wherein the LRU first port and the second port each includes a bellows member connected to one of a planar and a spherical flange.

11. The system of claim 9, wherein the LRU includes an optical table configured to support at least one adjustable optical element.

12. The system of claim 11, wherein the factory system includes at least one reference fixture configured to measure a light beam for refining the position of at least one of an LRU and an element supported by an LRU.

13. The system of claim 11, wherein at least one LRU optical element position is set in the factory system, the set optical element position being unchanged in the field system.

14. The system of claim 11, wherein the field system comprises at least a portion of a laser weapon system.

15. A line replaceable unit (LRU), comprising:

a table member having a first side and a second side, the table member first side being configured to support at least one LRU component, the table member second side being configured to mate with a mount in one of a factory system and a corresponding field system;

an environmental enclosure surrounding an LRU interior region including at least a portion of the table member, the LRU environmental enclosure having a first port and a second port, the first port being configured to receive a first isolation plug for effectively sealing the first port, the second port being configured to receive a second isolation plug for effectively sealing the second port, the LRU interior region being effectively isolated when both the first and second ports are sealed.

16. The LRU of claim 15, further comprising:

at least one optical component disposed on the table member first side.

17. In a field system corresponding to a factory system, a maintenance method comprises:

positioning a line replaceable unit (LRU) including one or more components in the field system on a mount adjacent to a first air lock (AL) and a second AL, the LRU including an environmental enclosure surrounding an LRU interior region and having an LRU first port and an LRU second port, the first AL including an environmental enclosure surrounding a first AL interior region and having a first AL first port and a first AL second port, the second AL including an environmental enclosure surrounding a second AL interior region and having a second AL first port and a second AL second port, the mount being configured to receive, support, and precisely locate the positioned LRU for proper operation within the field system without adjustment of the one or more LRU components;

connecting the LRU first port to the first AL second port to form a first air-tight conduit between the LRU and the first AL, at least one of the LRU first port and the first AL second port including a seal to prevent communication between the LRU and the first AL;

connecting the LRU second port to the second AL first port to form a second air-tight conduit between the LRU and the second AL, at least one of the LRU second port and the second AL first port including a seal to prevent communication between the LRU and the second AL;

decontaminating the first AL interior region and the second AL interior region;

removing one or more seals from between the first AL and the LRU to permit communication between the first AL and the LRU, the first air-tight conduit forming an air-tight communication path between the first AL and the LRU; and removing one or more seals from between the second AL and the LRU to permit communication between the second AL and the LRU, the second air-tight conduit forming an air-tight communication path between the second AL and the LRU.

18. The method of claim 17, wherein the operation of decontaminating the first AL interior region and the second AL interior region includes purging contaminants from the AL using a purging gas.

19. The method of claim 17, the method further comprising at least one of:

sealing at least one of the LRU first port and the first AL second port;

sealing at least one of the LRU second port and the second AL first port;

separating the first AL second port and the LRU first port to open the first conduit;

separating the LRU second port and the second AL first port to open the second conduit.

20. The method of claim 19, wherein the operation of sealing at least one of the LRU first port and the first AL second port includes applying one of a first isolation plug and a third isolation plug, and wherein the operation of sealing at least one of the LRU second port and the second AL first port includes applying one of a second isolation plug and a fourth isolation plug.

21. The method of claim 20, wherein at least one of the first isolation plug and the third isolation plug are configured to mate together and the second isolation plug and a fourth isolation plug are configured to mate together.

22. The method of claim 19, wherein the operation of separating the first AL second port and the LRU first port to open the first conduit includes retracting at least one flexible bellows assembly configured to form an air- tight seal between the first AL and the LRU, and wherein the operation of separating the second AL first port and the LRU second port to open the second conduit includes retracting at least one flexible bellows assembly configured to form an air- tight seal between the second AL and the LRU.

23. The method of claim 17, the method further comprising:

removing an old LRU previously positioned on the mount.

24. The method of claim 17, the method further comprising:

positioning a line replaceable unit (LRU) in a factory system on a factory system mount corresponding to the field system mount;

examining the factory system LRU to determine proper operation and calibration; and adjusting the LRU if calibration is needed.

* * * * *